US011020970B2

(12) United States Patent
Kobayashi

(10) Patent No.: US 11,020,970 B2
(45) Date of Patent: Jun. 1, 2021

(54) LIQUID EJECTING HEAD, LIQUID EJECTING APPARATUS, AND METHOD OF MANUFACTURING LIQUID EJECTING HEAD

(71) Applicant: SEIKO EPSON CORPORATION, Tokyo (JP)

(72) Inventor: Haruki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/801,553

(22) Filed: Feb. 26, 2020

(65) Prior Publication Data

US 2020/0276814 A1 Sep. 3, 2020

(30) Foreign Application Priority Data

Feb. 28, 2019 (JP) ..... JP2019-035568

(51) Int. Cl.
*B41J 2/14* (2006.01)
*B41J 2/175* (2006.01)

(52) U.S. Cl.
CPC ..... *B41J 2/14274* (2013.01); *B41J 2/1429* (2013.01); *B41J 2/14145* (2013.01); *B41J 2/17513* (2013.01); *B41J 2/17523* (2013.01); *B41J 2002/14467* (2013.01); *B41J 2002/14491* (2013.01)

(58) Field of Classification Search
CPC ..... B41J 2/14274; B41J 2/17523; B41J 2/17513; B41J 2/14145; B41J 2/1429; B41J 2002/14491; B41J 2002/14467; B41J 2002/14362; B41J 2/14233
See application file for complete search history.

(56) References Cited

U.S. PATENT DOCUMENTS 4,633,274 A * 12/1986 Matsuda ..... B41J 2/14024 346/139 C

FOREIGN PATENT DOCUMENTS

JP 2006-272885 10/2006
JP 2015-139939 8/2015

* cited by examiner

*Primary Examiner* — Geoffrey S Mruk
(74) *Attorney, Agent, or Firm* — Workman Nydegger

(57) ABSTRACT

A liquid ejecting head including nozzles ejecting a liquid, a flow path member including flow paths that communicate with the nozzles, and an electric substrate stacked on the flow path member in a first direction. The flow path member includes pipes that protrude in the first direction from a surface facing the electric substrate, the flow paths respectively being formed inside the pipes. Through holes through which the pipes are inserted are provided in the electric substrate. The through holes include a first through hole and a second through hole. The pipes include a first pipe that includes a first contact surface that contacts an internal circumferential surface of the first through hole and a second pipe that includes a second contact surface that contacts an internal circumferential surface of the second through hole.

14 Claims, 14 Drawing Sheets

LIQUID EJECTING HEAD, LIQUID EJECTING APPARATUS, AND METHOD OF MANUFACTURING LIQUID EJECTING HEAD

The present application is based on, and claims priority from JP Application Serial Number 2019-035568, filed Feb. 28, 2019, the disclosure of which is hereby incorporated by reference herein in its entirety.

BACKGROUND

1. Technical Field

The present disclosure relates to a liquid ejecting head including an electric substrate pertaining to driving of a drive element, a liquid ejecting apparatus, and a method of manufacturing the liquid ejecting head.

2. Related Art

A liquid ejecting apparatus includes a liquid ejecting head and is an apparatus that ejects various liquids from the ejecting head. While the above liquid ejecting apparatus includes an image recording apparatus such as, for example, an ink jet printer or an ink jet plotter, in recent years, taking advantage of the strong point of being able to accurately apply a very small amount of liquid to a predetermined position, the liquid ejecting apparatus is applied to various manufacturing apparatuses. For example, the liquid ejecting apparatus is applied to a display manufacturing apparatus that manufactures a color filter of a liquid crystal display and the like, an electrode forming apparatus that forms electrodes of an electroluminescence (EL) display and a field emission display (FED), and a chip manufacturing apparatus that manufactures biochips. Furthermore, in a recording head for an image recording apparatus, liquid ink is ejected, and in a coloring material ejecting head for a display manufacturing apparatus, solution of various colors, namely, red (R), green (G), and blue (B) is ejected. Furthermore, in an electrode material ejecting head for an electrode forming apparatus, a liquid electrode material is ejected, and in a bio-organic matter ejecting head for a chip manufacturing apparatus, solution of a bio-organic matter is ejected.

The liquid ejecting head is configured of layers of a plurality of constituting members. For example, a liquid ejecting head disclosed in JP-A-2015-139939 is configured of layers including a head body that includes nozzles and the like that eject a liquid, a downstream flow path member that holds the head body and that supplies ink to the head body, a relay substrate (in other words, an electric substrate) held on the downstream flow path member, and an upstream flow path member. In such a configuration, positioning protruded portions protrude from a surface of the downstream flow path member on which the relay substrate is held. The position of the relay substrate with respect to the flow path member is set by inserting and fitting the protruded portions into recessed portions (in other words, through holes) in the relay substrate. Furthermore, pipe-shaped protrusions serving as upstream end portions of the inner flow paths protrude from the surface of the relay substrate on which the flow path member is held, and corresponding to the above, flow path insertion holes through which the protrusions are inserted are provided in the relay substrate.

In the configuration described above, since the through holes through which the projections for the ink supplying flow paths are inserted, and the positioning through holes are provided in the relay substrate, circuit wiring and disposing of chips cannot be performed in the above area where the holes are formed. Accordingly, the circuit wiring and the like are formed at positions avoiding the area where the holes are formed and, as a result, the electric substrate becomes large in size and, consequently, a problem in that the liquid ejecting head becomes large in size occurs.

SUMMARY

The liquid ejecting head according to the present disclosure has been proposed in view of the above issue and includes a plurality of nozzles that eject a liquid, a flow path member including flow paths that supply the liquid to the nozzles, and an electric substrate layered on the flow path member in a first direction. The flow path member includes a plurality of pipes that protrude in the first direction from a surface on a side on which the electric substrate is layered, and the flow paths is formed inside the pipes. A plurality of through holes through which the pipes are inserted are provided in the electric substrate, and the plurality of pipes include a first pipe that includes a contact surface that contacts an internal circumferential surface of the through hole, and a second pipe that includes a contact surface that contacts an internal circumferential surface of the through hole.

DESCRIPTION OF EXEMPLARY EMBODIMENTS

Hereinafter, exemplary embodiments for carrying out the present disclosure will be described with reference to the drawings. Note that in the exemplary embodiments described below, various limitations are described as specific examples suitable for the present disclosure; however, the scope of the present disclosure is not limited to the configurations described below unless there is a description particularly implying that the present disclosure is limited thereby. Furthermore, an ink jet printer in which an ink jet recording head, which is a type of liquid ejecting head, is mounted is described hereinafter as an example of the liquid ejecting apparatus of the present disclosure.

Figure 1:
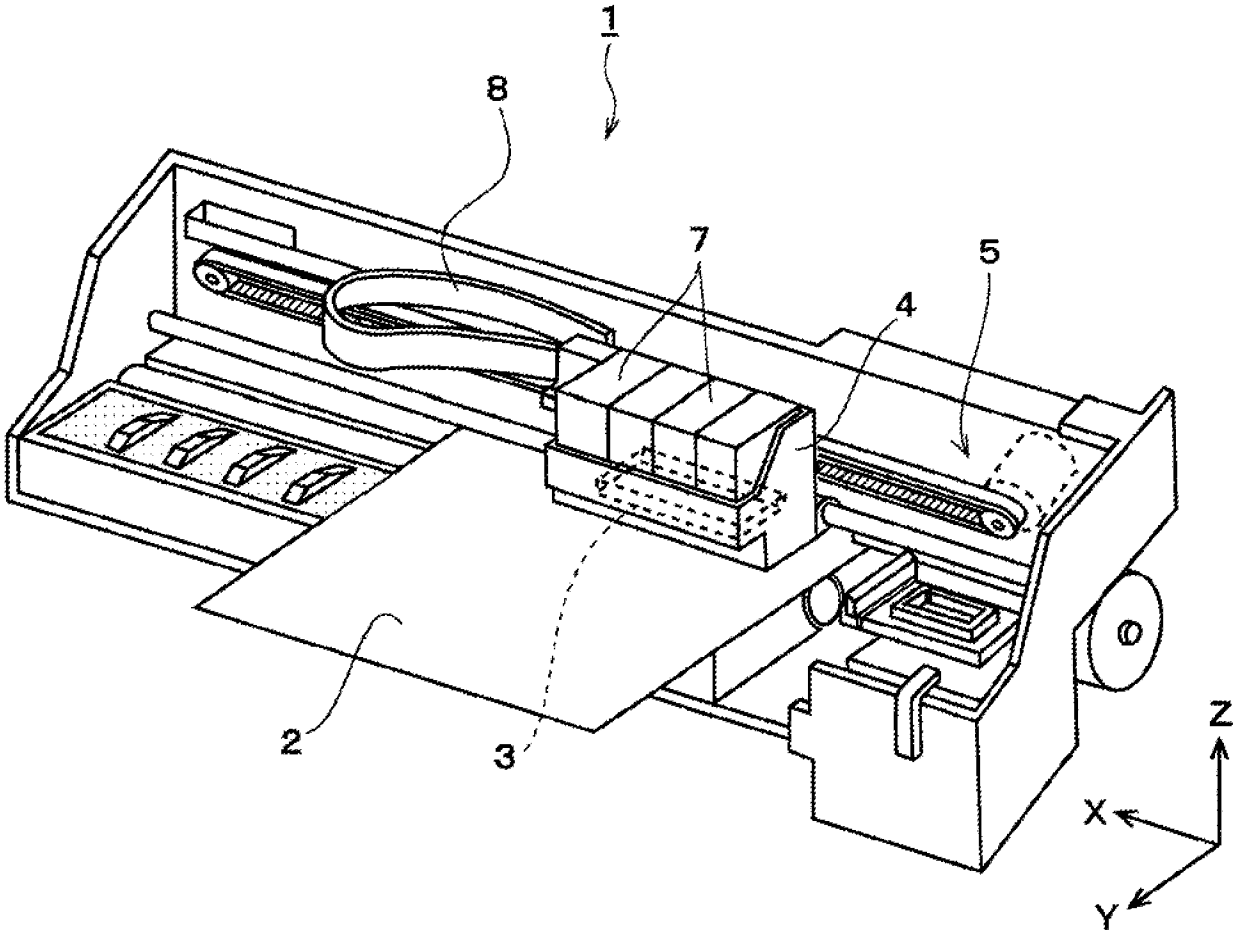
FIG. 1 is a perspective view illustrating a configuration of a liquid ejecting apparatus.

Referring first to FIG. 1, a configuration of a liquid ejecting apparatus 1 according to the present exemplary embodiment will be described. The liquid ejecting apparatus 1 is an apparatus that records an image and the like on a surface of a medium 2, such as recording paper, by ejecting liquid ink. Hereinafter, among an X direction, a Y direction, and a Z direction that are orthogonal to each other, the Y direction (corresponding to a second direction in the present disclosure) is a transport direction of the medium 2 or is a direction of relative movement between the medium 2 and a liquid ejecting head 3, the X direction (corresponding to a third direction of the present disclosure) is a direction orthogonal to the transport direction, and the Z direction (corresponding to a first direction in the present disclosure) is a direction orthogonal to an XY plane. Furthermore, a tip side of an arrow, the arrow depicting a direction, is referred to as a (+) direction and a base end side of the arrow, the arrow depicting a direction, is referred to as a (−) direction.

The liquid ejecting apparatus 1 includes the liquid ejecting head 3, a carriage 4 to which the liquid ejecting head 3 is attached, and a carriage moving mechanism 5 that reciprocates the carriage 4 in a main scanning direction (the X direction) that is a width direction of the medium 2. Furthermore, the liquid ejecting apparatus 1 includes a transport mechanism and the like (not shown) that transports the medium 2 in the transport direction (the Y direction). Note that the ink described above is a kind of liquid of the present disclosure and is stored in ink cartridges 7 serving as liquid storing members. The ink cartridges 7 are mounted on the liquid supplying unit 10 (described later) of the liquid ejecting head 3 in a detachable manner. Note that a configuration can be adopted in which the ink cartridges 7 are disposed on a main body side of the liquid ejecting apparatus 1 and in which the ink is supplied to the liquid ejecting head 3 from the ink cartridges 7 through ink supply tubes.

Figure 2:
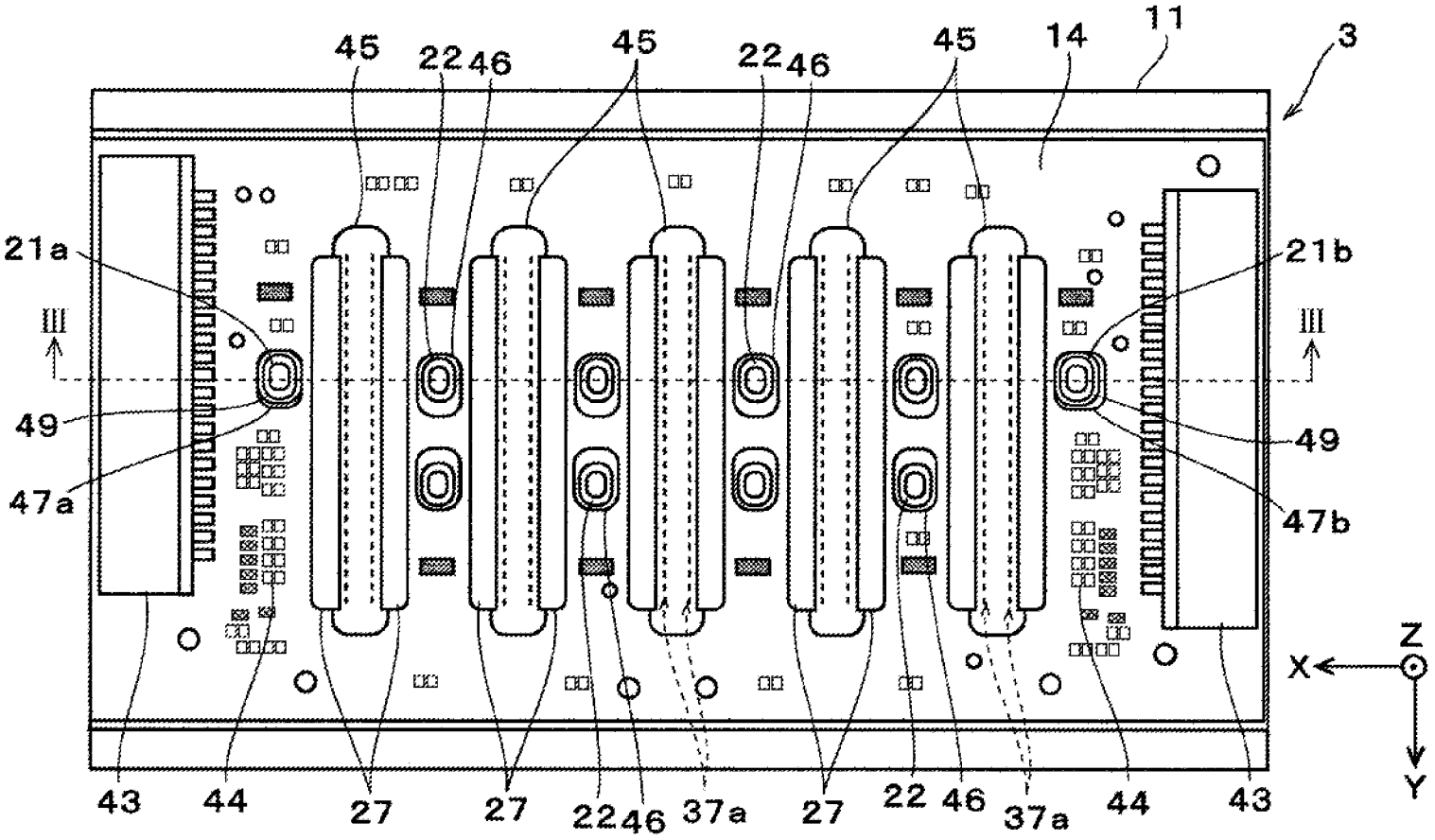
FIG. 2 is a plan view of a liquid ejecting head.
Figure 3:
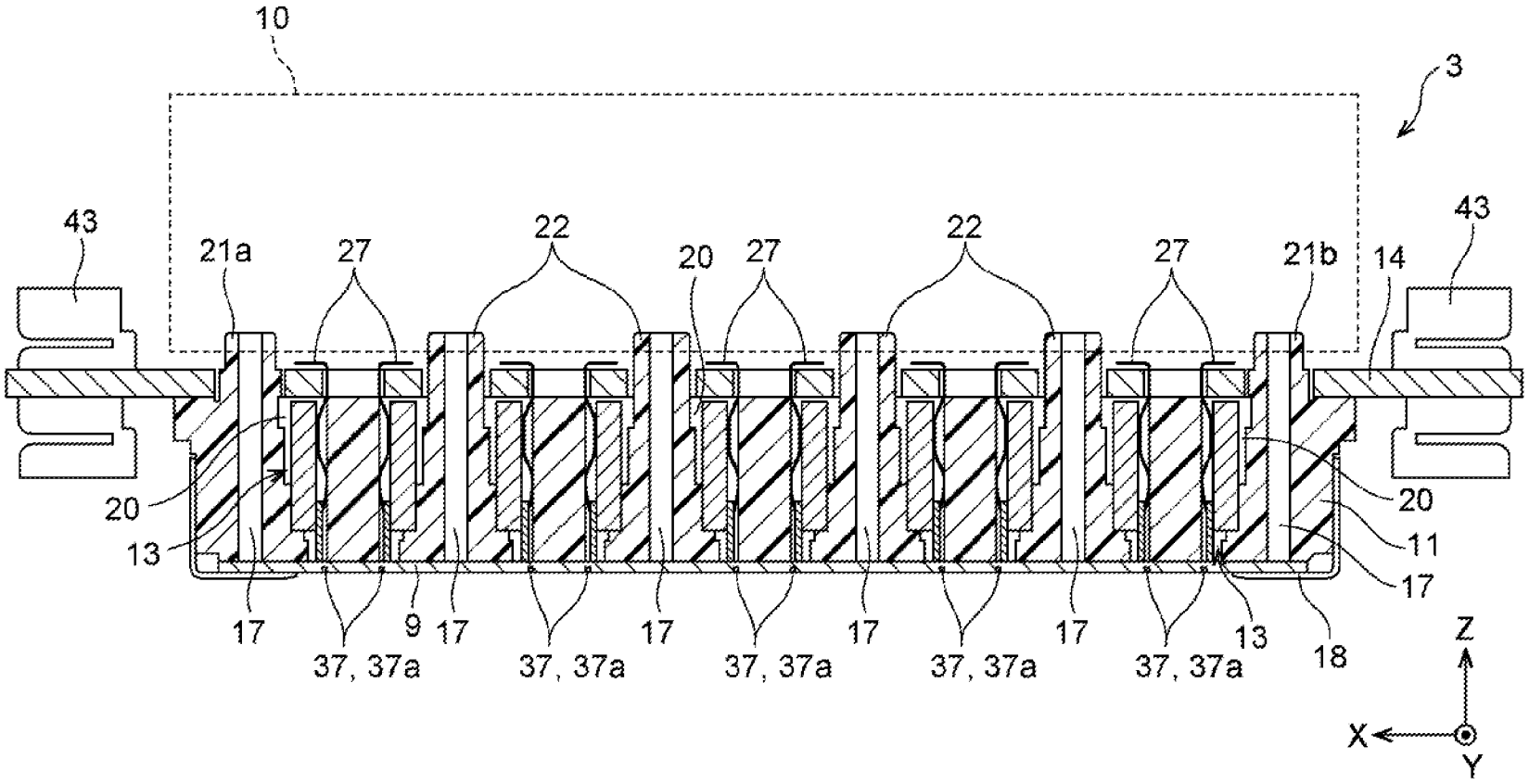
FIG. 3 is a cross-sectional view taken along line III-III in FIG. 2.
Figure 4:
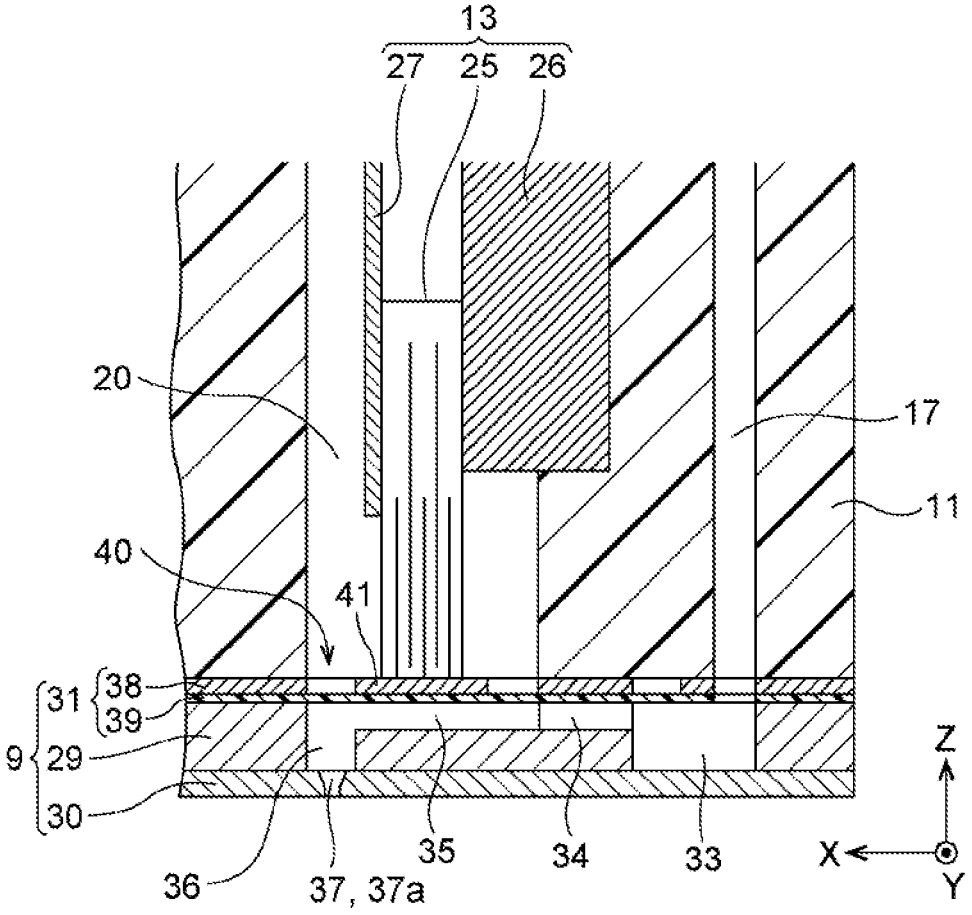
FIG. 4 is a cross-sectional view of a vicinity of a flow path unit.

FIG. 2 is a plan view of the liquid ejecting head 3 viewed in the +Z direction, and FIG. 3 is a cross-sectional view taken along line III-III in FIG. 2. Furthermore, FIG. 4 is a cross-sectional view illustrating a configuration of a vicinity of a flow path unit 9 of the liquid ejecting head 3. Note that in FIG. 2, an illustration of the liquid supplying unit 10 is omitted, and in FIG. 3, the liquid supplying unit 10 is depicted by a broken line. Furthermore, an illustration of a head cover 18 is omitted in FIG. 4. Hereinafter, when assuming that a nozzle surface (in other words, a nozzle plate 30 described later) in which nozzles 37 of the liquid ejecting head 3 are formed is a surface parallel to the XY plane described above, the Z direction is a direction orthogonal to the nozzle surface.

The liquid ejecting head 3 according to the exemplary embodiment includes the liquid supplying unit 10, a head case 11, and an electric substrate 14, which may also be referred to as a circuit substrate, disposed between the liquid supplying unit 10 and the head case 11. The liquid supplying unit 10 is a structure including flow paths in which the ink flows, filters that perform filtration of the ink, and other members. The liquid supplying unit 10 distributes the ink stored in the ink cartridges 7 to introduction flow paths of the head case 11 through the internal flow paths.

The head case 11 is a synthetic resin member in which accommodation chambers 20 that accommodate actuator units 13 therein and in which introduction flow paths 17 that are liquid flow paths that introduce the ink supplied from the supplying unit 10 to the flow path unit 9 are formed. The head case 11 is a type of flow path member according to the disclosure. The head cover 18 that is formed of metal such as stainless steel and in which an opening portion that exposes the nozzle surface of the flow path unit 9 is provided is, after the flow path unit 9 has been joined thereto, joined to an undersurface of the head case 11 in the Z direction. Furthermore, the electric substrate 14 and the liquid supplying unit 10 are mounted on an upper surface of the head case 11 in the Z direction. In the present exemplary embodiment, a total of ten actuator units 13 corresponding to ten nozzle rows 37*a* formed in the nozzle plate 30 are provided so as to be arranged in the X direction and accommodated in the accommodation chambers 20 provided separately. Note that the number of actuator units 13 is not limited to the number described as an example.

The plurality of introduction flow paths 17 that introduce the ink from the liquid supplying unit 10 to the flow path unit 9 are formed inside the head case 11 at positions deviated from the accommodation chambers 20. The introduction flow paths 17 penetrate through the head case 11 in the height direction, or in the Z direction, of the head case 11. Furthermore, a plurality of cylindrical pipes serving as upper end portions of the introduction flow paths 17 are formed so as to protrude in the +Z direction in the surface of the head case 11 on the side on which the liquid supplying unit 10 and the electric substrate 14 are mounted. Among the plurality of pipes, the pipes positioned at both sides of the electric substrate 14 in the longitudinal direction or in the X direction, which is a direction in which the nozzle rows 37*a* described later are arranged, are positioning pipes 21, and the pipes formed in an area between the positioning pipes 21 are third pipes 22. The pipes 21 and 22 connect the introduction flow paths 17 formed in the head case 11 and the internal flow paths of the liquid supplying unit 10 in a liquid-tight manner. Details of the positioning pipes 21 and the third pipes 22 will be described later.

As illustrated in FIG. 4, the actuator units 13 described above include piezoelectric elements 25 functioning as drive elements (may also be referred to as pressure generating elements or actuators), fixing plates 26 to which the piezoelectric elements 25 are joined, and wiring members 27 that supply drive signals to the piezoelectric elements 25. Note that the piezoelectric element 25 according to the present exemplary embodiment is a piezoelectric element of a so-called longitudinal vibration mode which is displaced in a direction intersecting the electric field direction. When a drive signal is supplied, the piezoelectric element 25 is displaced, in other words, stretched, in a direction intersecting the direction in which the piezoelectric material and the electrode are layered. A distal end portion of the piezoelectric element 25 is joined to an island portion 41 of the flow path unit 9.

The flow path unit 9 is configured so that the nozzle plate 30 is joined to a surface of a flow path substrate 29 on a first side in the Z direction (on a −Z direction side) and so that a vibrating plate 31 is joined to a surface of the flow path substrate 29 on a second side in the Z direction (on a +Z direction side). A common liquid chamber 33, an individual supply path 34, a pressure chamber 35, a nozzle communication hole 36, and the nozzle 37 are provided in the flow path unit 9. In the present exemplary embodiment, the nozzles 37 are formed in the nozzle plate 30, and the common liquid chambers 33, the individual supply paths 34, the pressure chambers 35, and the nozzle communication holes 36 are formed in the flow path substrate 29. Note that the flow path substrate 29 may be configured of a plurality of layered substrates.

The nozzle plate 30 described above is a plate material in which the plurality of nozzles 37 are formed at predetermined pitches in the Y direction, and is fabricated of a metal plate such as, for example, a single crystal substrate or stainless steel. A plurality of nozzle rows 37*a* (nozzle groups) each configured of a plurality of nozzles 37 arranged in the Y direction are provided in the nozzle plate 30. In the present exemplary embodiment, a total of 10 nozzle rows 37*a* are arranged in the nozzle plate 30 in the X direction.

The flow path substrate 29 is a plate material fabricated of a single crystal substrate, for example. The plurality of pressure chambers 35 arranged in the Y direction are formed in the flow path substrate 29 so as to correspond to the nozzles 37 described above. In the flow path substrate 29, the common liquid chamber 33 is formed in an area deviated towards the outside in the X direction with respect to the areas where the pressure chambers 35 are formed. The common liquid chamber 33 and the pressure chambers 35 communicate with each other through the individual supply paths 34 provided in the pressure chambers 35. The common liquid chamber 33 is a liquid chamber commonly provided for the pressure chambers 35 and stores the ink supplied through the introduction flow paths 17 of the head case 11. A sectional area of the flow path of the individual supply path 34 is smaller than a sectional area of the pressure chamber 35. The nozzle communication hole 36 that penetrates in the thickness direction, or the Z direction, of the flow path substrate 29 is formed on a side of the pressure chamber 35 opposite the individual supply path 34 side. Each nozzle communication hole 36 is a flow path that communicates the pressure chamber 35 and the corresponding nozzle 37 of the nozzle plate 30 to each other in a one-to-one manner. Note that the pressure chambers 35, the individual supply paths 34, and nozzle communication holes 36 in the flow path substrate 29 are formed by anisotropic etching.

The vibrating plate 31 described above has a double structure in which a support plate 38 and an elastic film 39 are layered. In the present exemplary embodiment, the support plate 38 is, for example, a stainless steel plate that is a type of metal plate. The vibrating plate 31 is configured of a composite plate in which a resin film, serving as the elastic film 39, is laminated on a surface of the support plate 38. Diaphragms 40 that change the volumes of the pressure chambers 35 are provided in the vibrating plate 31. The diaphragms 40 are fabricated by partially removing the support plate 38 by etching or the like. In other words, the diaphragms 40 are formed by, while the portions of the support plate 38 to which the front end surfaces of the piezoelectric elements 25 are joined are left as the island portions 41, removing, in a circular shape, the support plate 38 around the island portions 41 and having the elastic film 39 alone remain. Furthermore, since the front end surfaces of the piezoelectric elements 25 are joined to the island portions 41, when the piezoelectric elements 25 become stretched, the diaphragms 40 become displaced accordingly and, due to the above, the volumes of the pressure chambers 35 fluctuate. In accordance with the fluctuation in volume, pressure fluctuation (in other words, pressure change) occurs in the ink inside the pressure chamber 35.

Furthermore, in the liquid ejecting head 3 configured in the above manner, while in a state in which the flow paths from the common liquid chamber 33 through the pressure chambers 35 to the nozzles 37 are filled with ink, by driving the piezoelectric elements 25 in accordance with the drive signals that are applied through the wiring members 27 from the electric substrate 14 described later, a pressure fluctuation occurs in the ink inside each pressure chamber 35, and due to the pressure oscillation, the ink is ejected from the corresponding predetermined nozzle 37. Note that while in the present exemplary embodiment, a configuration including a so-called longitudinally vibrating piezoelectric elements 25 as the actuator units 13 has been described as an example; however, a configuration including a so-called flexural oscillation type piezoelectric elements can be adopted as well. The drive elements are not limited to the piezoelectric elements and, other than the above, drive elements such as electrostatic actuators or heating elements that are configured to eject a liquid such as ink from the nozzles 37 can be adopted as well.

The electric substrate 14 according to the present exemplary embodiment is a printed substrate (in other words, a rigid substrate) long in the X direction orthogonal to the Y direction, which is a nozzle row direction. In other words, the electric substrate 14 is long in the X direction in which the plurality of nozzle rows 37*a* are arranged. As illustrated in FIGS. 2 and 3, the electric substrate 14 includes, at both sides thereof in the X direction, connectors 43 to which flexible flat cables (FFC) 8 are connected from a printer main body side, and mounted components 44 such as IC chips, resistors, and the like on the upper surface thereof. Furthermore, wiring openings 45 into which the wiring members 27 coupled to the piezoelectric elements 25 are inserted are formed in the electric substrate 14 so as to penetrate the electric substrate 14 in a substrate thickness direction (in other words, the Z direction). In plan view in the Z direction, each wiring opening 45 has an opening shape that is longer in the Y direction than the width of the wiring member 27. Two wiring members 27 are inserted through a single wiring opening 45. In the electric substrate 14 according to the present exemplary embodiment, a total of five wiring openings 45 are formed so as to be arranged in the X direction. Substrate terminal portions (not shown) are formed in edge portions on both sides of each wiring opening 45 in the X direction, and wiring terminal portions of the corresponding wiring member 27 that have been inserted through the corresponding wiring opening 45 from the lower surface side of the electric substrate 14 are electrically joined to the substrate terminal portions. The electric substrate 14 has a wiring function that sends electric signals, such as a drive signal, sent from the printer main body side through the FFC 8 to the wiring members 27. Furthermore, by transmitting the electric signal sent through the electric substrate 14 to the actuator units 13, voltage is applied to the piezoelectric elements 25. Switching elements (not shown), such as transmission gates, that switches between supplying and not supplying the electric signals to the piezoelectric elements 25 are provided in the wiring members 27 of the exemplary embodiment. Note that a configuration in which the switching elements are provided in the electric substrate 14 as the mounted components 44 may be adopted as well.

Furthermore, a plurality of through holes 46 and 47 that penetrate the electric substrate 14 in the substrate thickness direction (in other words, the Z direction) are formed at the positions corresponding to the pipes 21 and 22. As illustrated in FIG. 2, in the present exemplary embodiment, two through holes 46 are formed so as to be arranged in the Y direction at areas between adjacent wiring openings 45. The positioning through holes 47 that are, as described later, through holes also functioning as positioning holes are formed on both end sides of the electric substrate 14 in the X direction, which is a longitudinal direction, specifically, on the outside of the wiring openings 45 that are positioned at both ends in the X direction among the plurality of wiring openings 45 or on the connector 43 sides. Among the above positioning through holes 47, an opening shape of a first positioning through hole 47*a* on a first end side (the left side in FIG. 2 or on the +Z direction side) and an opening shape of a second positioning through hole 47*b* on a second end side (the right side in FIG. 2 or on the −Z direction side) are, as described later, different. Note that first positioning through hole 47*a* according to the present exemplary embodiment is an example of a "first through hole", and the second positioning through hole 47*b* is an example of a "second through hole". A further detailed description of the configurations of the pipes 21 and 22 and the through holes 46 and 47 are given below.

Figure 5:
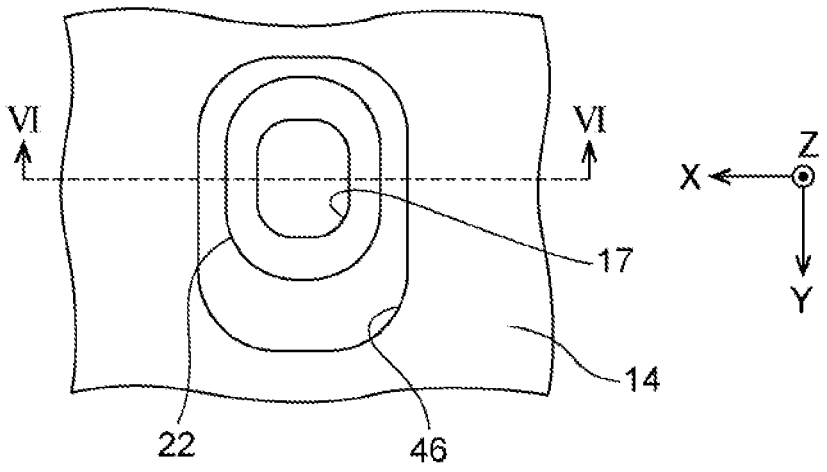
FIG. 5 is a plan view of a vicinity of a third pipe and a through hole in an electric substrate.
Figure 6:
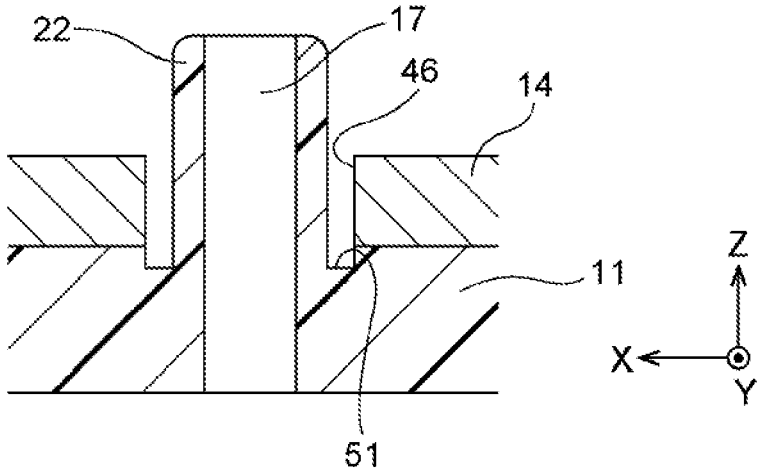
FIG. 6 is a cross-sectional view taken along line VI-VI in FIG. 5.
Figure 7:
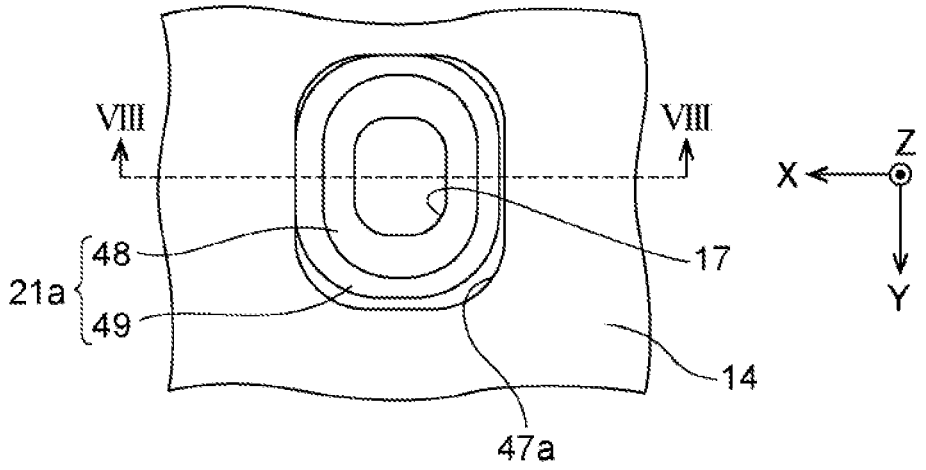
FIG. 7 is a plan view illustrating a configuration of a vicinity of a first positioning through hole and a first pipe according to the electric substrate.
Figure 8:
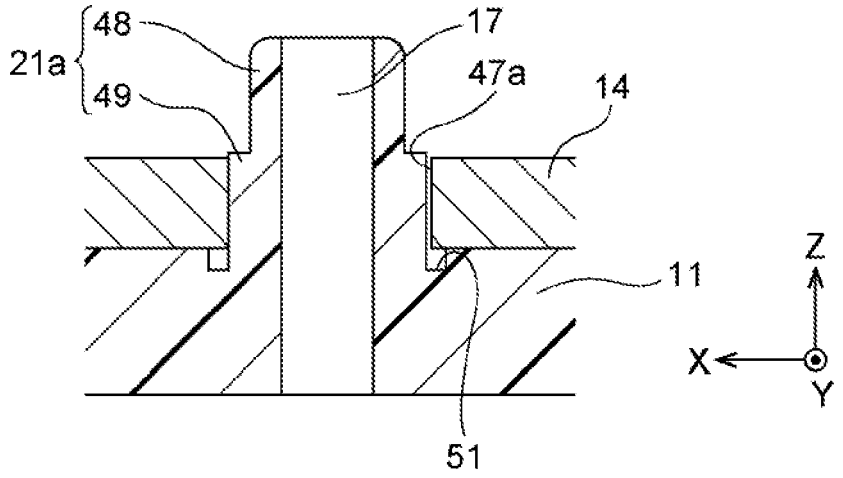
FIG. 8 is a cross-sectional view taken along line VIII-VIII in FIG. 7.
Figure 9:
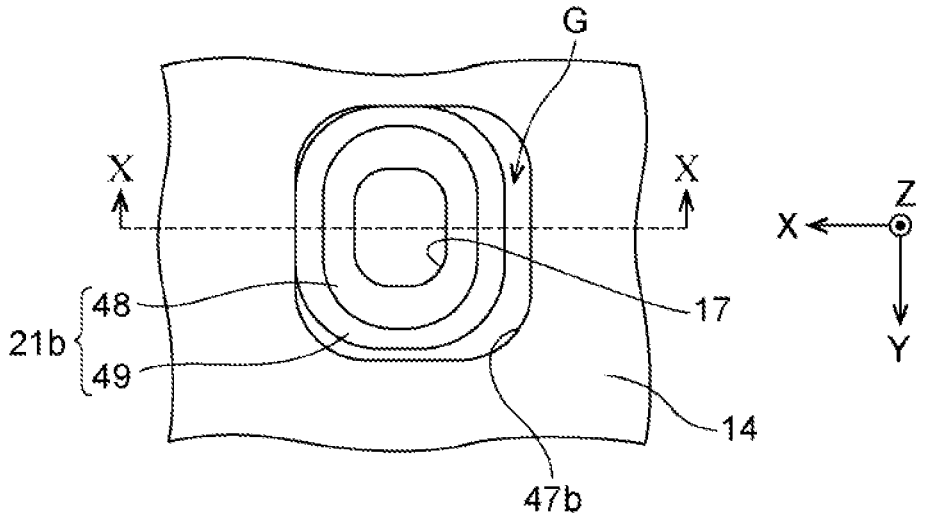
FIG. 9 is a plan view illustrating a configuration of a vicinity of a second positioning through hole and a second pipe according to the electric substrate.
Figure 10:
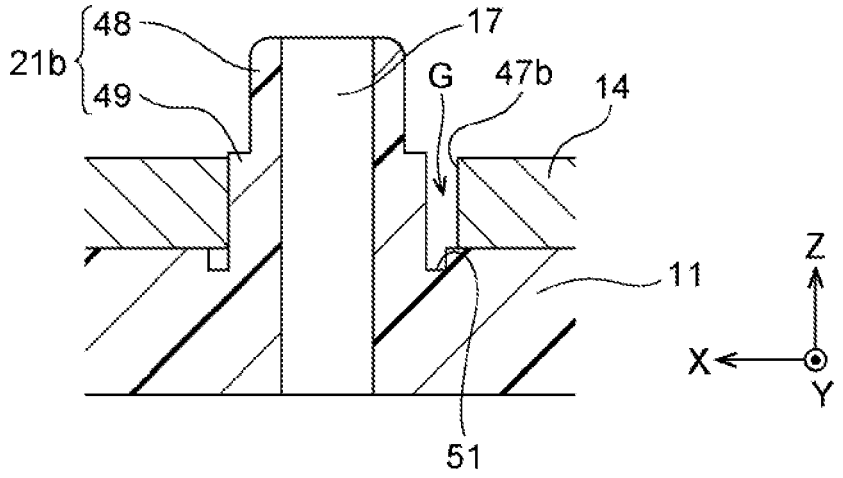
FIG. 10 is a cross-sectional view taken along line X-X in FIG. 9.

FIG. 5 is a plan view illustrating a configuration of the electric substrate 14 near the through hole 46 and the third pipe 22, and FIG. 6 is a cross-sectional view taken along line VI-VI in FIG. 5. Furthermore, FIG. 7 is a plan view illustrating a configuration of the electric substrate 14 near the first positioning through hole 47*a* and a first pipe 21*a*, and FIG. 8 is a cross-sectional view taken along line VIII-VIII in FIG. 7. Moreover, FIG. 9 is a plan view illustrating a configuration of the electric substrate 14 near the second positioning through hole 47*b* and a second pipe 21*b*, and FIG. 10 is a cross-sectional view taken along line X-X and FIG. 9. Note that in the present exemplary embodiment, the first pipe 21*a* on the first end side in the X direction and the second pipe 21*b* on the second end side have the same shape, and when describing a configuration that is common to the above two pipes, each of the two pipes are merely referred to as a positioning pipe 21.

As illustrated in FIG. 6, the third pipe 22 according to the present exemplary embodiment is a cylindrical member protruding towards the upper side in the Z direction (in other words, towards the liquid supplying unit 10 side) from a pipe formation surface 51 that is a surface lowered a notch towards an under surface side on which the flow path unit 9 is joined with respect to an upper surface (hereinafter, a layered surface) of the head case 11 on which the electric substrate 14 is layered. The pipe formation surface 51 faces the electric substrate 14. A peripheral portion of a distal end surface (in other words, a top face) of the third pipe 22 of the present exemplary embodiment is rounded so as to have a tapered shape. With the above, when the liquid supplying unit 10 and the electric substrate 14 are attached to the head case 11, the third pipes 22 can be inserted through the internal flow paths of the liquid supplying unit 10 in a smooth manner. A protrusion length of the third pipe 22 from the pipe formation surface 51 is set longer than a thickness of the electric substrate 14 and, in a state in which the third pipe 22 is inserted through the through hole 46 and the electric substrate 14 is layered on the layered surface of the head case 11, a distal end portion of the third pipe 22 protrudes towards the liquid supplying unit 10 side from an upper surface of the electric substrate 14. Note that the pipes 21 and 22 according to the present exemplary embodiment are illustrated, as an example, so as to protrude from the pipe formation surface 51 towards the +Z direction side; however, not limited to the above, a configuration in which the pipes 21 and 22 protrude in the +Z direction from the layered surface on which the electric substrate 14 is layered can be adopted. In brief, it is only sufficient that the pipes 21 and 22 protrude from a surface on the side on which the electric substrate 14 is layered. Note that the through hole 46 according to the present exemplary embodiment is an example of a "third through hole".

As illustrated in FIG. 5, in the present exemplary embodiment, an external shape of the third pipe 22 in plan view in the +Z direction is an elliptic shape (in other words, a track shaped) long in the Y direction. An opening shape of the through hole 46 through which the third pipe 22 is inserted is set larger than an external shape of the third pipe 22. In other words, the through hole 46 has an elliptic shape long in the Y direction corresponding to the planar shape of the third pipe 22, and the dimension of the external shape of the through hole 46 is set larger than the dimension of the external shape of the third pipe 22. In other words, the dimension of the through hole 46 in the Y direction and the dimension thereof in the X direction are set larger than the dimension of the third pipe 22 in the Y direction and the dimension thereof in the X direction, respectively. Accordingly, in a state in which the electric substrate 14 is positioned with the positioning pipes 21 and the positioning through holes 47 and is layered on the head case 11, there is a gap between an external circumferential surface of the third pipe 22 and an internal circumferential surface of the through hole 46, and the third pipe 22 and the through hole 46 do not come in contact with each other. In other words, the third pipe 22 is inserted into the through hole 46 while non-contacting the through hole 46.

As illustrated in FIGS. 7 and 9, the first pipe 21*a* and the second pipe 21*b* serving as the positioning pipes 21 according to the present exemplary embodiment are, similar to the third pipes 22, cylindrical members protruding towards the upper side in the Z direction (the +Z direction) from the pipe formation surface 51. Furthermore, similar to the third pipes 22, the distal end surfaces of the positioning pipes 21 are rounded so as to have tapered shapes and, the entire protrusion length of each positioning pipe 21 from the pipe formation surface 51 is matched with the protrusion length of each third pipe 22. Accordingly, in a state in which the positioning pipes 21 are inserted through the positioning through holes 47 and the electric substrate 14 is layered on the layered surface of the head case 11, distal end portions of the positioning pipes 21 protrude towards the liquid supplying unit 10 side with respect to the upper surface of the electric substrate 14.

As illustrated in FIGS. 7 to 10, the positioning pipe 21 according to the present exemplary embodiment is different from the third pipe 22 in that the positioning pipe 21 includes a coupling portion 48 that is coupled to the internal flow path of the liquid supplying unit 10, and a positioning portion 49 formed on a base end side (in other words, on the pipe formation surface 51 side) with respect to the coupling portion 48. In plan view, the coupling portion 48 is formed with a shape and a size that are similar to those of the third pipe 22. In other words, the external shape of the third pipe 22 in plan view is an elliptic shape and, in the present exemplary embodiment, is an elliptic shape long in the Y direction. On the other hand, the positioning portion 49 has, in plan view, a shape that is similar to the shape of the coupling portion 48, and a dimension of an external shape of the positioning portion 49 is set larger than a dimension of an external shape of the coupling portion 48. In other words, the positioning portion 49 has an elliptic shape corresponding to the planar shape of the coupling portion 48. Furthermore, a dimension of the positioning portion 49 in the Y direction and a dimension thereof in the X direction are set larger than a dimension of the coupling portion 48 in the Y direction and a dimension thereof in the X direction, respectively. In other words, the positioning portion 49 is a portion where the external shape thereof has been increased compared with that of the coupling portion 48, and a thickness of the positioning portion 49 in a direction parallel to the XY plane is larger than that of the coupling portion 48. Hereinafter, the description will be given assuming that the shape and the dimension of the positioning pipe 21 in plan view are the shape and the dimension of the positioning portion 49 in plan view.

The top face of the positioning portion 49 in the Z direction (a surface on the +Z direction side) is set to be flush with the upper surface of the electric substrate 14 layered on the layered surface or is above (in other words, is on the distal end side of the coupling portion 48) the upper surface of the electric substrate 14. The external circumferential surface of such a positioning portion 49 defines the relative position between the head case 11 and the electric substrate 14 by contacting the internal circumferential surface of the positioning through hole 47, and functions as a contact surface of the present disclosure. In other words, in addition to functioning as flow paths forming the introduction flow paths 17, the positioning pipes 21 additionally functions as a positioning pin that defines the relative position between the head case 11 and the electric substrate 14. Furthermore, the positioning through hole 47 functioning as a through hole through which the positioning pipe 21 is passed additionally functions as a positioning hole that defines the relative position between the head case 11 and the electric substrate 14. Furthermore, by additionally providing the positioning portion 49 that is thicker than the coupling portion 48, the external circumferential surface of the positioning portion 49 can be formed as a contact surface having a higher accuracy and more flatness compared with the coupling portion 48 including a tapered shape at the distal end portion thereof, and the positioning accuracy can be increased.

As illustrated in FIG. 3, the positioning pipes 21 according to the present exemplary embodiment are disposed outside the nozzle rows 37*a* disposed at both ends in the X direction among the plurality of nozzle rows 37*a*. In other words, among the plurality of pipes provided in the head case 11, the first pipe 21*a* disposed on the first end side in the X direction (on the left side in FIG. 2 in the present exemplary embodiment or on the +X direction side) and the second pipe 21*b* disposed on the second end side in the X direction (on the right side in FIG. 2 or on the −X direction side) are two pipes, among the plurality of pipes, that are disposed farthest away from each other. By adopting such a configuration, a longer distance between the first pipe 21*a* and the second pipe 21*b* (in other words, the distance between the center of the first pipe 21*a* and the center of the second pipe 21*b*) related to positioning of the head case 11 and the electric substrate 14 can be obtained and, accordingly, the positioning accuracy is improved further. Furthermore, the first pipe 21*a* and the second pipe 21*b* are disposed so that an imaginary straight line connecting the first pipe 21*a* and the second pipe 21*b* extends in the X direction. As illustrated in FIG. 7, the external shape of the first positioning through hole 47*a*, among the positioning through holes 47*a* and 47*b* through which the positioning pipes 21 are inserted, on the first end side in plan view is set larger than the external shape of the coupling portion 48 and is set about the same or slightly larger than the external shape of the positioning portion 49. In other words, the first positioning through hole 47*a* has an elliptic shape corresponding to the planar shape of the positioning portion 49 of the positioning pipe 21 and, furthermore, the dimension of the first positioning through hole 47*a* in the Y direction and the dimension thereof in the X direction as set about the same or slightly larger than the dimension of the positioning portion 49 in the Y direction and the dimension thereof in the X direction. In brief, the first positioning through hole 47*a* is a through hole in which the opening dimension thereof is, within a range allowing the positioning portion 49 to be inserted therethrough, set so that a gap between the first positioning through hole 47*a* and the external circumferential surface of the positioning portion 49 is small. Accordingly, in a case in which the electric substrate 14 is mounted on a mounting surface of the head case 11, when the first pipe 21*a* is inserted into the first positioning through hole 47*a*, at least a portion of the external circumferential surface of the positioning portion 49 of the first pipe 21*a* comes in contact with the internal circumferential surface of the first positioning through hole 47*a*.

As illustrated in FIGS. 9 and 10, in the second positioning through hole 47*b* on the second end side, among the positioning through holes 47*a* and 47*b* through which the positioning pipes 21 are inserted, while the dimension in the Y direction is set so as to match the dimension of the first positioning through hole 47*a*, the dimension in the X direction that is a direction in which the second positioning through hole 47*b* and the first positioning through hole 47*a* are arranged is set larger than the dimension of the first positioning through hole 47*a* in the X direction. Accordingly, in a case in which the electric substrate 14 is mounted on the mounting surface of the head case 11, when the second pipe 21*b* is inserted through the second positioning through hole 47*b*, a gap G is formed in the X direction between the external circumferential surface of the positioning portion 49 of the second pipe 21*b* and the internal circumferential surface of the second positioning through hole 47*b*, which allows the head case 11 and the electric substrate 14 to be positioned while absorbing, within the range of the gap G, an error between the distance between the first pipe 21*a* and the second pipe 21*b* and the distance between the positioning through holes 47*a* and 47*b*.

When manufacturing the liquid ejecting head 3 and when the electric substrate 14 is layered on the layered surface of the head case 11, the third pipes 22 of the head case 11 is inserted through the through holes 46 of the electric substrate 14 while non-contacting the through holes 46 and, furthermore, the positioning pipes 21 at both sides in the X direction are inserted into the positioning through holes 47*a* and 47*b* so that the internal circumferential surfaces of the positioning through holes 47*a* and 47*b* are in contact with the external circumferential surfaces of the positioning portions 49 of the positioning pipes 21; accordingly, the position of the electric substrate 14 with respect to the head case 11 is set.

As described above, since the configuration of the present disclosure, the plurality of pipes in which the introduction flow paths 17 are formed includes positioning pipes 21 that include the contact surfaces (the external circumferential surfaces of the positioning portions 49 in the present exemplary embodiment) that come in contact with the internal circumferential surfaces of the positioning through holes 47, the positioning pipes 21 function as positioning pins that position the head case 11 and the electric substrate 14, and the positioning through holes 47 through which the positioning pipes 21 are inserted function as positioning holes that position the head case 11 and the electric substrate 14. Accordingly, other than the pipes 21 and 22 and the through holes 46 and 47 into which the pipes 21 and 22 are inserted, projections (in other words, positioning pins) that determine the position of the head case 11 and the electric substrate 14 and positioning holes through which the projections are inserted do not need to be separately provided. Accordingly, more space, amounting to the space saved with the above, for disposing the wiring and the mounted components 44 can be obtained on the electric substrate 14 and a reduction in the size of the electric substrate 14 can be achieved. As a result, a contribution to size reduction of the liquid ejecting head 3 can be made. Furthermore, since known positioning projections are not needed, shortcomings such as a decrease in liquid tightness of the flow paths between the members caused by such projections coming in contact with the other members (the liquid supplying unit 10 in the present exemplary embodiment, for example) when manufacturing the liquid ejecting head can be suppressed from occurring.

Note that while positioning of the head case 11 and the electric substrate 14 can be performed with at least one set of the positioning pipe 21 of the head case 11 and the positioning through hole 47 of the electric substrate 14, by providing two or more sets of the positioning pipe 21 and the positioning through hole 47 and performing positioning at a plurality of portions, the positioning accuracy can be improved furthermore. Furthermore, in the present exemplary embodiment, the pipes, namely, the first pipe 21*a* and the second pipe 21*b*, are disposed at both end sides of the electric substrate 14 in the X direction, and the distance between the first pipe 21*a* and the second pipe 21*b* disposed at both end sides (in other words, the distance between the center of the first pipe 21*a* and the center of the second pipe 21*b* in the Z direction in plan view) is longer than a dimension of the electric substrate 14 in a short direction (in the Y direction in the present exemplary embodiment). Furthermore, while in the present exemplary embodiment, a configuration in which the pipes 21 and 22 are provided integrally with the head case 11 has been described as an example, a configuration in which the pipes 21 and 22 provided as members separate to the head case 11 are attached to the head case 11 may be adopted as well. Furthermore, in the exemplary embodiment described above, while a configuration in which the positioning portions 49 are formed in the positioning pipes 21 and in which the external circumferential surfaces of the positioning portions 49 function as the contact surfaces has been described as an example, the present disclosure is not limited to such a configuration. For example, a configuration in which portions corresponding to the positioning portion 49 are not provided in the positioning pipes 21, in other words, a configuration in which the positioning pipes 21 and the third pipes 22 have a common shape and in which the external circumferential surfaces of the positioning pipes 21 themselves function as the contact surfaces may be adopted as well. Furthermore, a configuration in which positioning portions 49 that are members separate from the positioning pipes 21 are attached to external circumferences of the positioning pipes 21 can be adopted as well. In such a case, the positioning portions 49 can be configured of a material, such as metal, different from that of the positioning pipes 21. As described above, in a configuration in which the positioning portions 49 are separate members, by forming the contact surfaces of the positioning portions 49 more accurately, the positioning accuracy can be improved furthermore.

Figure 11:
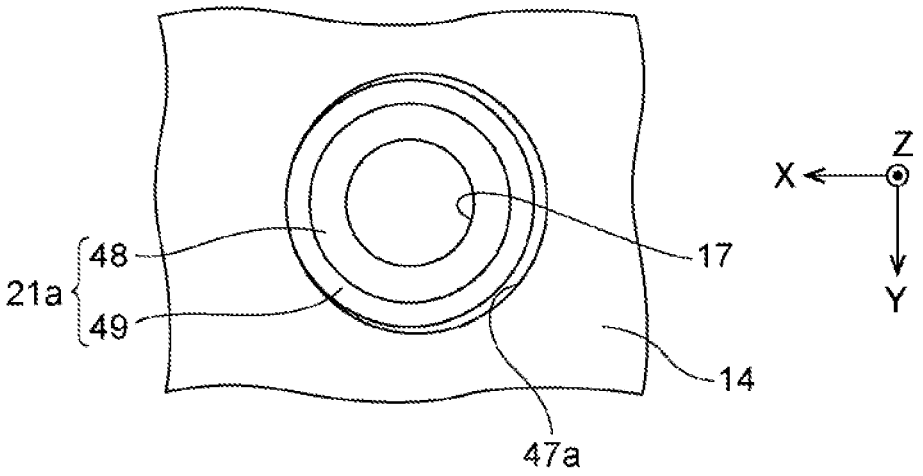
FIG. 11 is a plan view illustrating a configuration of a first pipe and a first positioning through hole according to a first modification.
Figure 12:
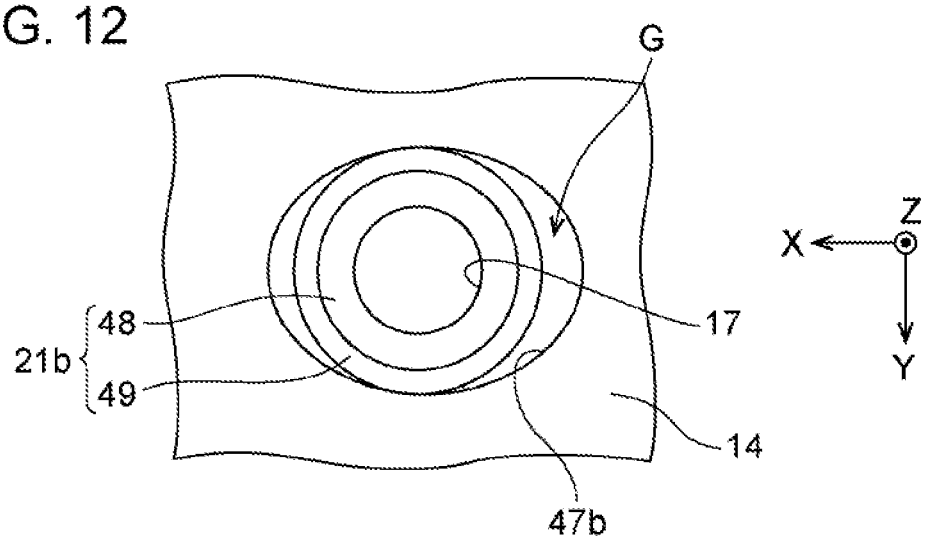
FIG. 12 is a plan view illustrating a configuration of a second pipe and a second positioning through hole according to the first modification.

FIGS. 11 and 12 are diagrams illustrating a first modification of the positioning pipe 21 and the positioning through hole 47. FIG. 11 is a plan view illustrating a configuration of the first pipe 21*a* and the first positioning through hole 47*a* according to the first modification. FIG. 12 is a plan view illustrating a configuration of the second pipe 21*b* and the second positioning through hole 47*b* according to the first modification. In the first exemplary embodiment, a configuration in which the external shapes of the two third pipes 22 in plan view are each an elliptic shape has been described as an example; however, not limited to such a configuration, the third pipes 22 can adopt various shapes.

For example, as illustrated in FIGS. 11 and 12, the external shapes of the first pipe 21*a* and the second pipe 21*b* serving as positioning pipes 21 according to the first modification, in other words, the planar shapes of the coupling portion 48 and the positioning portion 49 are both a perfect circle. Furthermore, the shape of the first positioning through hole 47*a* through which the first pipe 21*a* on the first end side is inserted is a perfect circle in plan view. The size of the first positioning through hole 47*a* is set so that the gap between the first positioning through hole 47*a* and the external circumferential surface of the positioning portion 49 is small within the range allowing the positioning portion 49 to be inserted through the first positioning through hole 47*a*. Accordingly, in a case in which the electric substrate 14 is mounted on the mounting surface of the head case 11, when the first pipe 21*a* is inserted into the first positioning through hole 47*a*, at least a portion of the external circumferential surface of the positioning portion 49 comes in contact with the internal circumferential surface of the first positioning through hole 47*a*. Here, the term "perfect circle" means not only a perfect circle but also a somewhat incomplete one. In brief, a perfect circle includes a circle that can generally be visually recognized as a substantially perfect circle in plan view.

As illustrated in FIG. 12, while a dimension of the second positioning through hole 47*b*, through which the second pipe 21*b* on the second end side is inserted, in the Y direction is set to match the dimension of the first positioning through hole 47*a*, a dimension in the X direction, which is a direction in which the second positioning through hole 47*b* and the first positioning through hole 47*a* are arranged, is set larger than the dimension of the first positioning through hole 47*a* in the X direction. In other words, in plan view, the second positioning through hole 47*b* has an elliptic shape long in the X direction. Furthermore, in a case in which the electric substrate 14 is mounted on the mounting surface of the head case 11, when the second pipe 21*b* is inserted through the second positioning through hole 47*b*, a gap G is formed in the X direction between the external circumferential surface of the positioning portion 49 of the second pipe 21*b* and the internal circumferential surface of the second positioning through hole 47*b*, which allows the head case 11 and the electric substrate 14 to be positioned while absorbing, within the range of the gap G, an error between the distance between the first pipe 21*a* and the second pipe 21*b* and the distance between the positioning through holes 47*a* and 47*b*.

Figure 13:
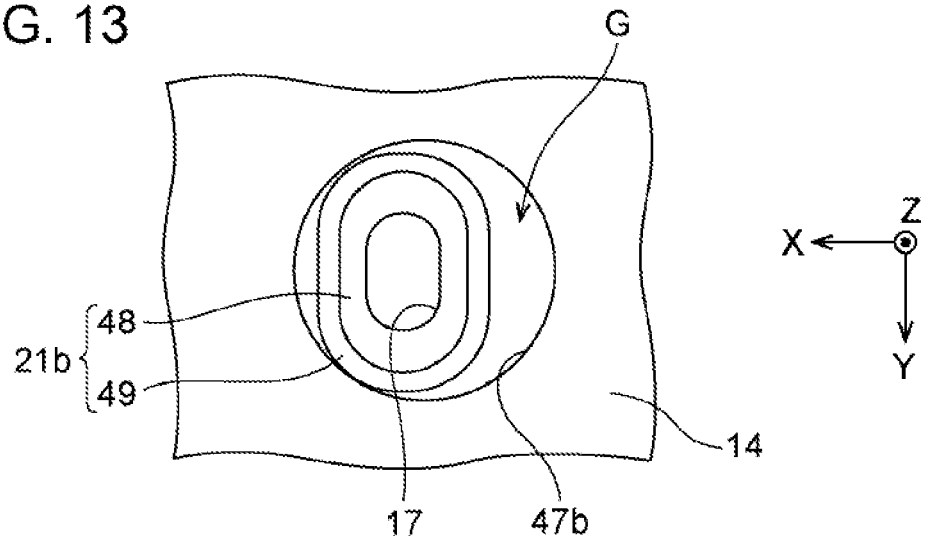
FIG. 13 is a plan view illustrating a configuration of a second pipe and a second positioning through hole according to a second modification.

FIG. 13 is a plan view illustrating a configuration of the second pipe 21*b* and the second positioning through hole 47*b* according to a second modification. In the present modification, while the configurations of the first pipe 21*a* on the first end side, among the two positioning pipes 21, and the first positioning through hole 47*a* through which the first pipe 21*a* is inserted are common with those of the first modification, the configurations of the second pipe 21*b* on the second end side and the second positioning through hole 47*b* through which the second pipe 21*b* is inserted are different from those of the first modification. In the present modification, the shape of the second positioning through hole 47*b* in plan view is a perfect circle similar to that of the first positioning through hole 47*a*. Furthermore, regarding the second pipe 21*b* on the second end side inserted through the second positioning through hole 47*b*, while a dimension in the Y direction when in plan view is set to match the diameter of the first pipe 21*a* on the first end side, a dimension in the X direction is set smaller than the diameter of the first pipe 21*a* on the first end side and an inner diameter of the second positioning through hole 47*b*. In other words, an external shape of the second pipe 21*b* according to the present modification in plan view is an elliptic shape long in the Y direction and short in the X direction. Accordingly, in a case in which the electric substrate 14 is mounted on the mounting surface of the head case 11, when the second pipe 21*b* is inserted through the second positioning through hole 47*b*, since a gap G is formed in the X direction between the external circumferential surface of the positioning portion 49 of the second pipe 21*b* and the internal circumferential surface of the second positioning through hole 47*b*, the head case 11 and the electric substrate 14 can be positioned while the gap G absorbs an error between the distance between the first pipe 21*a* and the second pipe 21*b* and the distance between the positioning through holes 47*a* and 47*b*.

Figure 14:
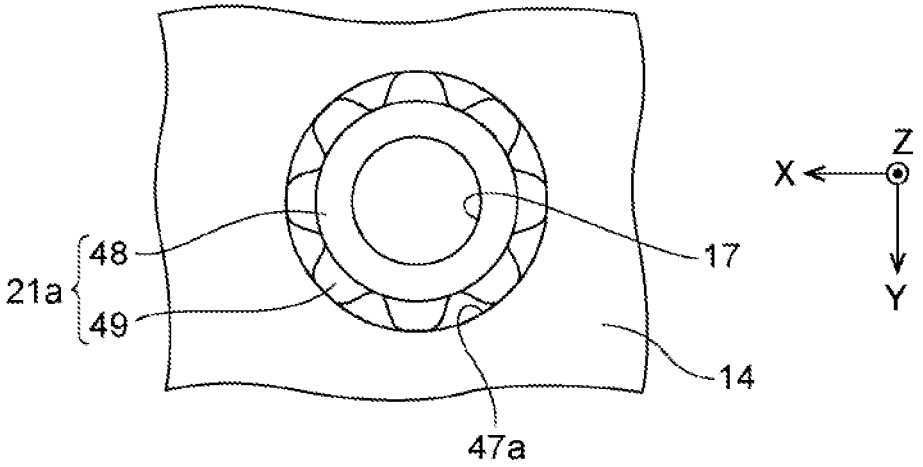
FIG. 14 is a plan view illustrating a configuration of a first pipe according to a third modification.

FIG. 14 is a plan view illustrating a configuration of the first pipe 21*a* and the second pipe 21*b* serving as the positioning pipes 21 according to a third modification. A feature of the positioning pipe 21 according to the present modification is that the positioning pipe 21 includes rib-shaped positioning portions 49 that are disposed along the external circumference of the coupling portion 48 at constant intervals. The positioning portion 49 is, in plan view, a portion protruding in a trapezoidal or triangular manner in a radial direction of the coupling portion 48 from the external circumferential surface of the coupling portion 48. A plurality of (eight in the present modification) positioning portions 49 are provided along the external circumference of the coupling portion 48. It goes without saying that such shapes of the rib-shaped positioning portion 49 in plan view and the number provided along the coupling portion 48 are not limited to those described as examples and various configurations can be adopted. Note that the positioning through holes 47*a* and 47*b* and other configurations are similar to those of the first modification described above. According to the present modification, since the contact areas between the external circumferential surfaces of the positioning pipe 21, in other words, the external circumferential surfaces of the positioning portions 49 functioning as the contact surfaces (in other words, ends of the positioning portions 49 protruding from the coupling portion 48) and the internal circumferential surfaces of the positioning through holes 47*a* and 47*b* are small, even when the gaps between the internal circumferential surface of the first positioning through hole 47*a* and the external circumferential surfaces of the positioning portions 49 are set smaller and the gaps with the second positioning through hole 47*b* in the Y direction are set smaller, the positioning portions 49 of the first and second pipes 21*a* and 21*b* can be inserted through the positioning through holes 47*a* and 47*b*. Accordingly, the external circumferential surfaces of the positioning portions 49 in the first and second pipes 21*a* and 21*b* and the internal circumferential surfaces of the positioning through holes 47 can be in contact with each other in a more reliable manner and the positioning accuracy can be improved further.

Figure 15:
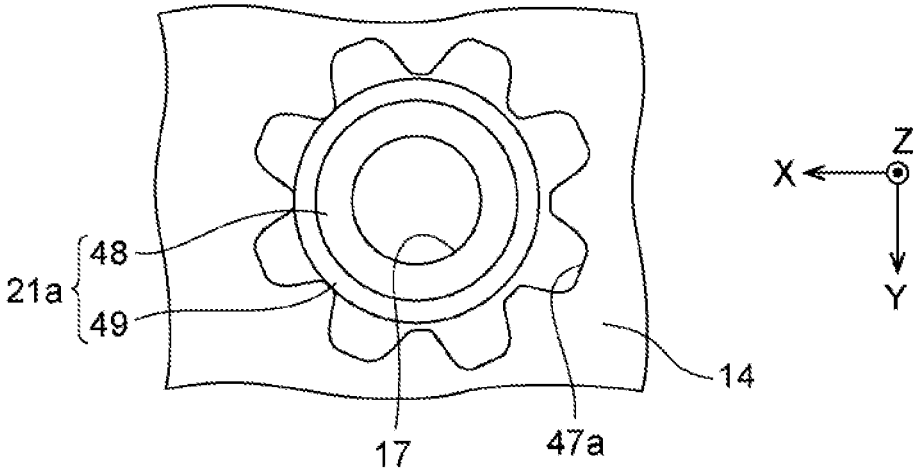
FIG. 15 is a plan view illustrating a configuration of a first positioning through hole according to a fourth modification.
Figure 16:
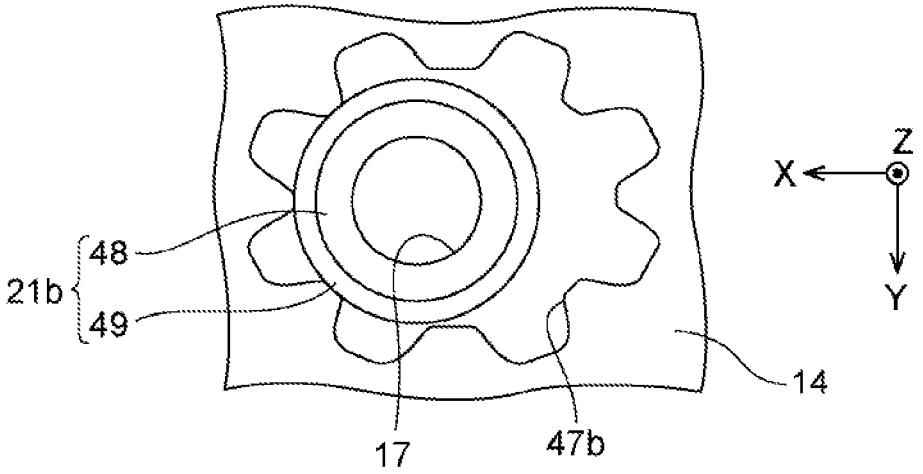
FIG. 16 is a plan view illustrating a configuration of a second positioning through hole according to a fourth modification.

FIGS. 15 and 16 are plan views illustrating configurations of the positioning through holes 47*a* and 47*b* according to a fourth modification. The first positioning through hole 47*a* according to the present modification has a recessed/protruded shape formed along the internal circumferential surface. The protruded portions provided in the internal circumferential surface of the first positioning through hole 47*a* are portions protruded in a trapezoidal or triangular manner from the internal circumferential surface towards the center. Furthermore, the second positioning through hole 47*b* has a shape in which the shape of the first positioning through hole 47*a* has been enlarged in the X direction. Note that the shapes and the numbers of the protruded portions of the positioning through holes 47*a* and 47*b* are not limited to those described as an example. The number of protrusions/recesses in the first positioning through hole 47*a* and the number of protrusions/recesses in the second positioning through hole 47*b* may be different and various configurations can be adopted. Note that the first and second pipes 21*a* and 21*b* and other configurations are similar to those of the first modification described above. According to the fourth modification, since the contact areas between the external circumferential surfaces of the first pipe 21*a* and the second pipe 21*b*, in other words, the external circumferential surfaces of the positioning portions 49 functioning as the contact surfaces and the internal circumferential surfaces of the positioning through holes 47*a* and 47*b* (in other words, the end surfaces of the protruded portions on the positioning pipe 21 side) are small, even when the gaps between the internal circumferential surface of the first positioning through hole 47*a* and the external circumferential surfaces of the positioning portions 49 are set smaller and the gaps with the second positioning through hole 47*b* in the Y direction are set smaller, the positioning portions 49 of the first and second pipes 21*a* and 21*b* can be inserted through the positioning through holes 47*a* and 47*b*. Accordingly, the external circumferential surfaces of the positioning portions 49 in the first and second pipes 21*a* and 21*b* and the internal circumferential surfaces of the positioning through holes 47*a* and 47*b* can be in contact with each other in a more reliable manner and the positioning accuracy can be improved further. Other than the above, the shapes of the positioning pipes 21 and the positioning through holes 47 in plan view (in other words, the external shapes) are not limited to the shapes described above as examples and various shapes such as a polygonal shape can be adopted. In brief, any configuration configured to position the head case 11 and the electric substrate 14 by having the contact surfaces of the positioning pipes 21 and the internal circumferential surfaces of the positioning through holes 47 contact each other is sufficient.

Figure 17:
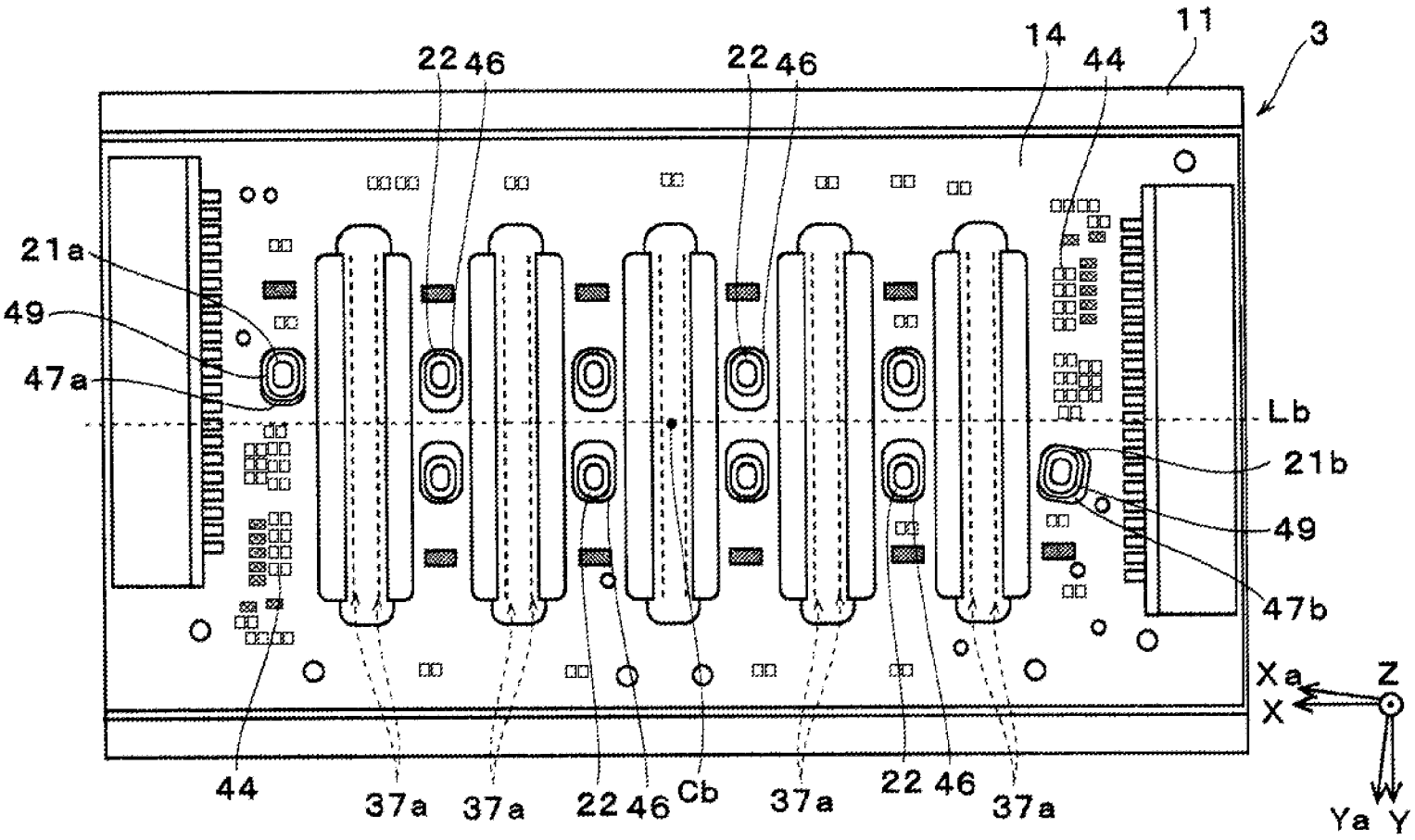
FIG. 17 is a plan view of a liquid ejecting head according to a second exemplary embodiment.

FIG. 17 is a plan view of the liquid ejecting head 3 according to a second exemplary embodiment viewed in the +Z direction. Illustration of the liquid supplying unit 10 is omitted. In the first exemplary embodiment described above, a configuration has been described as an example in which the direction in which the set of first pipe 21*a* and the first positioning through hole 47*a* and the set of the second pipe 21*b* and the second positioning through hole 47*b* are arranged is the X direction, in other words, a direction parallel to the longitudinal direction of the electric substrate 14; however, the configuration is not limited to the above. While the present exemplary embodiment is similar to the first exemplary embodiment in that the set of the first pipe 21*a* and the first positioning through hole 47*a* and the set of the second pipe 21*b* and the second positioning through hole 47*b* are disposed on both end sides of the electric substrate 14 in the X direction, the direction in which the sets are arranged is an Xa direction which is inclined against the X direction. In other words, the set of the first pipe 21*a* and the first positioning through hole 47*a* are disposed on a first side (the upper side in FIG. 17 with respect to an imaginary center line Lb) in the Y direction and the set of the second pipe 21*b* and the second positioning through hole 47*b* are disposed on a second side (the lower side in FIG. 17 with respect to the imaginary center line Lb) in the Y direction, so as to be point symmetric to each other about an imaginary center Cb of the electric substrate 14. With the above, since a longer distance between the sets (in other words, the distance between the center of the first pipe 21*a* and the center of the second pipe 21*b*) can be obtained, the positioning accuracy is improved further.

Regarding the set of the second pipe 21*b* and the second positioning through hole 47*b* in the present exemplary embodiment, the second pipe 21*b* is formed so that a direction of a major axis of the second pipe 21*b* having an elliptic shape extends in a Ya direction, and a direction of a minor axis thereof extends in the Xa direction, in other words, the second pipe 21*b* is formed so that the major axis and the minor axis are inclined from the Y direction and the X direction, respectively. Accordingly, regarding the planar shape of the second positioning through hole 47*b*, a dimension in the Ya direction is set to match the dimension of the first positioning through hole 47*a* in the Y direction, while the dimension in the Xa direction that is a direction in which the set of the second pipe 21*b* and the second positioning through hole 47*b* and the set of the first pipe 21*a* and the first positioning through hole 47*a* are arranged is set larger than the dimension of the first positioning through hole 47*a* in the X direction. With the above, the gap G formed between the external circumferential surface of the positioning portion 49 of the second pipe 21*b* and the internal circumferential surface of the second positioning through hole 47*b* becomes larger in the Xa direction, which is the direction in which the set of the first pipe 21*a* and the first positioning through hole 47*a* and the set of the second pipe 21*b* and the second positioning through hole 47*b* are arranged, than in the Ya direction orthogonal to the Xa direction. Accordingly, positioning of the head case 11 and the electric substrate 14 can be performed while absorbing the error between the distance between the first pipe 21*a* and the second pipe 21*b* and the distance between the positioning through holes 47*a* and 47*b*. Note that there may be no gap G in the Ya direction. Note that other configurations are similar to those of the first exemplary embodiment.

Figure 18:
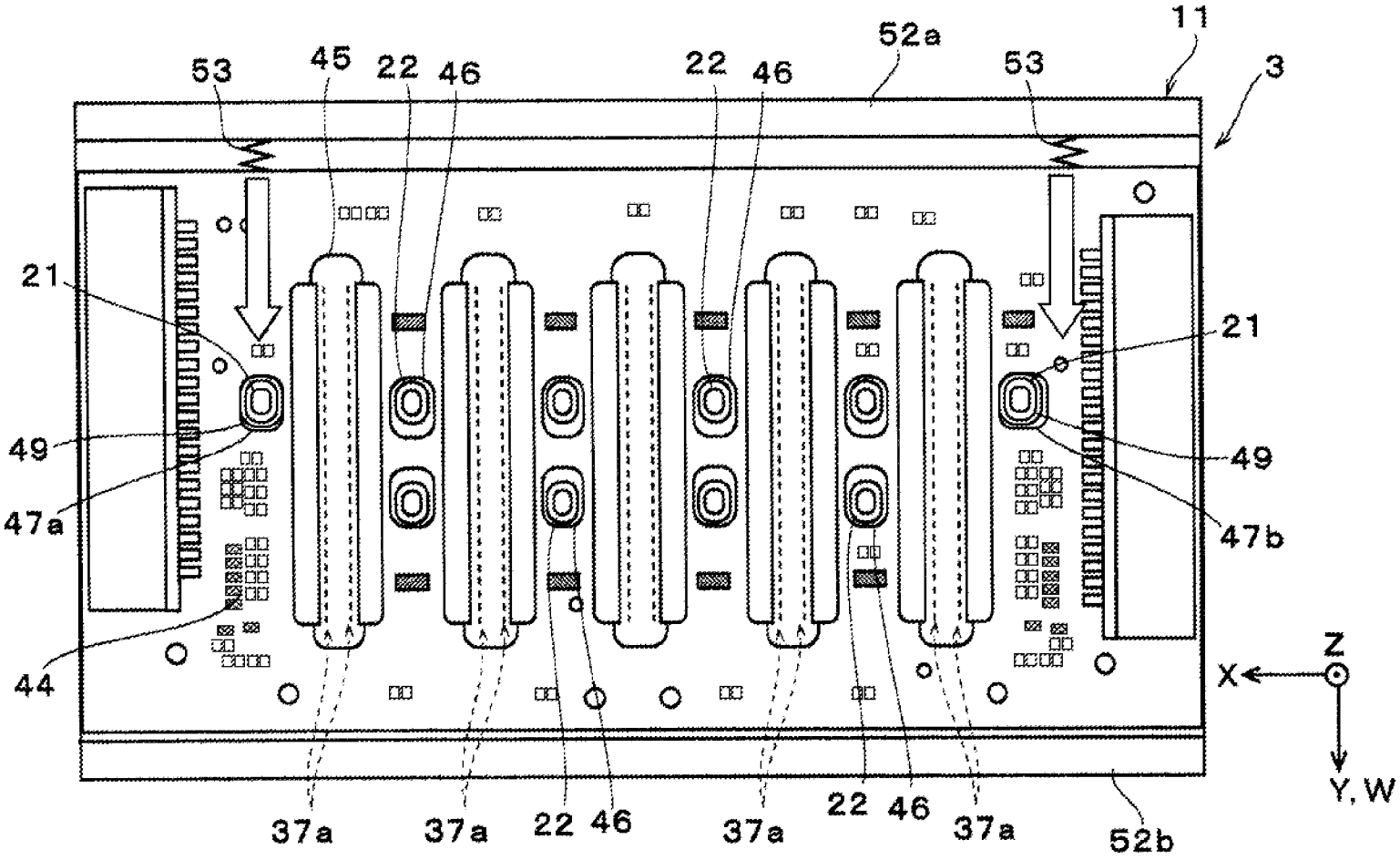
FIG. 18 is a plan view of a liquid ejecting head according to a third exemplary embodiment.

FIG. 18 is a plan view of the liquid ejecting head 3 according to a third exemplary embodiment viewed in the +Z direction. Illustration of the liquid supplying unit 10 is omitted. Note that the description will be given while in FIG. 18, the lower side in the Y direction (the +Y direction side) is referred to as the first side, and the upper side in the Y direction (the −Y direction side) is referred to as the second side (the same applies to FIG. 19). Features of the present exemplary embodiment are that walls 52*a* and 52*b* are formed at both sides of an area in the Y direction so as to surround the area, the area being an area in the mount surface of the head case 11 where the electric substrate 14 is mounted, and that urging members 53 that urge the electric substrate 14 towards the first side in a W direction, which is a fourth direction, are provided between the wall 52*a* on the second side and the electric substrate 14. In the example in FIG. 18, the W direction matches the Y direction or the second direction, and the urging members 53 urge the electric substrate 14 towards the first side in the W direction or the Y direction. With the above, the surfaces of the internal circumferential surfaces of the positioning through holes 47*a* and 47*b* on the second side in the W direction, in other words, the surfaces on the upper side of the drawing, and the surfaces of the positioning portions 49 of the first pipe 21*a* and the second pipe 21*b* on the second side in the W direction become reliably in contact with each other, and the positioning of the head case 11 and the electric substrate 14 are performed with a higher accuracy.

Note that the W direction that is the direction in which the urging members 53 urge the electric substrate 14 to one of the sides can be any direction, and may be a direction parallel to the X direction or may be a direction inclined from the X direction and the Y direction. For example, an elastic material such as rubber or elastomer, or a biasing member such as a spring can be adopted as the urging member 53. Furthermore, an eccentric cam, for example, can be adopted as the urging member 53. In such a case, while an external circumference of the eccentric cam is in contact with the electric substrate 14, the electric substrate 14 can be urged to one of the sides by the increase and decrease in the cam diameter from the rotation center of the eccentric cam to the portion in contact with the electric substrate 14 when the eccentric cam is rotated. Furthermore, a configuration, for example, in which the electric substrate 14 is urged to one of the sides according to a screwing amount of an adjusting screw while the distal end portion thereof is in contact with the electric substrate 14. Other configurations are similar to those of the first exemplary embodiment.

Figure 19:
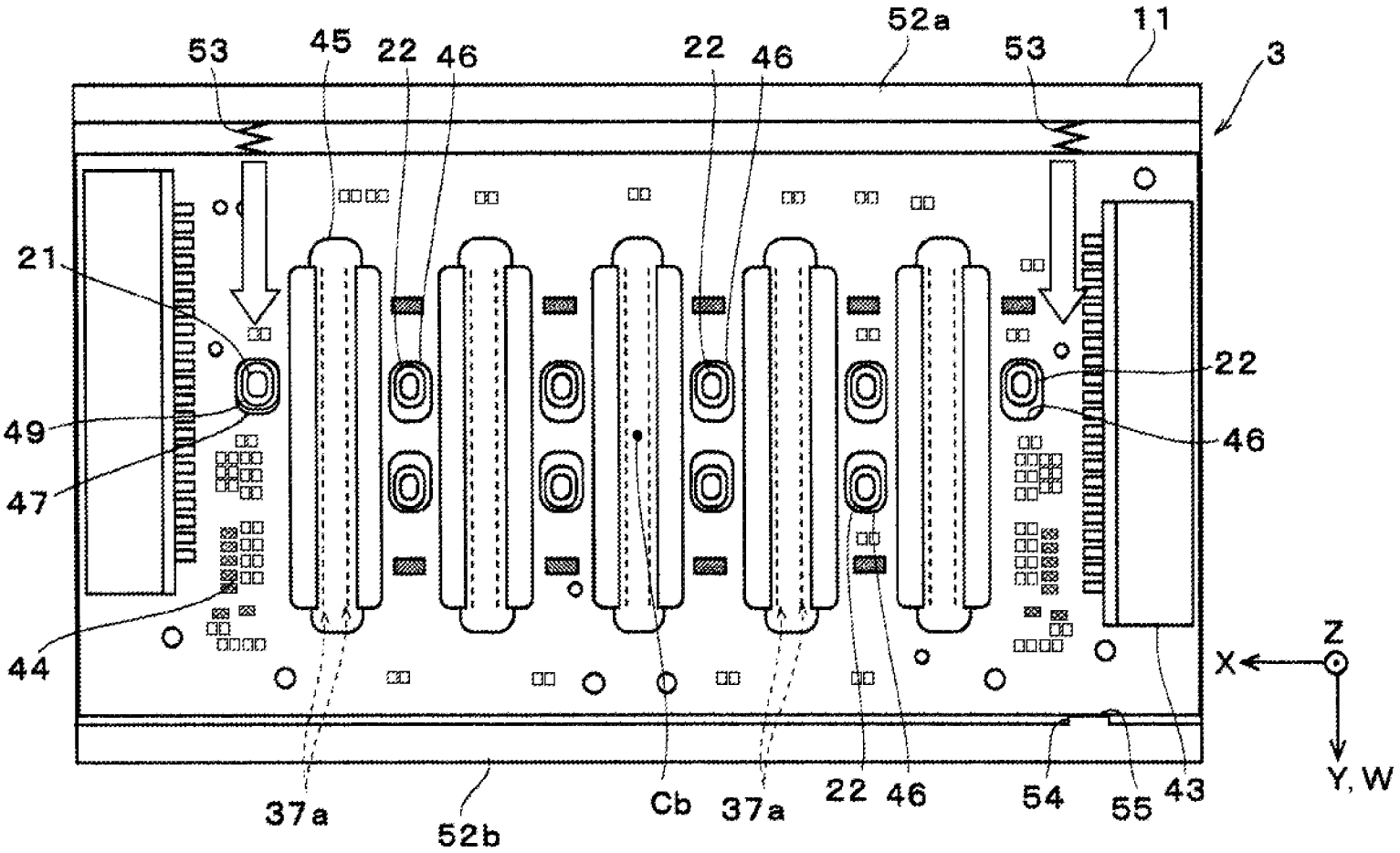
FIG. 19 is a plan view of a liquid ejecting head according to a modification of the third exemplary embodiment.

FIG. 19 is a plan view of the liquid ejecting head 3 according to a modification of the third exemplary embodiment viewed in the +Z direction. Illustration of the liquid supplying unit 10 is omitted. In the present modification, only a single set of the positioning pipe 21 and the positioning through hole 47 are provided, and the other sets are sets of the third pipe 22 and the through hole 46. Furthermore, in the wall 52*b* on the first side (the +Y direction side) among the walls 52*a* and 52*b* of the head case 11, a protruded portion 54 protruded towards the electric substrate 14 on the mount surface is formed on a second end side that is a side in the X direction opposite the side on which the positioning pipe 21 and the positioning through hole 47 are provided (in other words, an opposite side with the imaginary center Cb of the electric substrate 14 in between). An end surface of the protruded portion 54 on the electric substrate 14 side functions as an abutting surface 55 that defines the position of the electric substrate 14. In other words, in the present modification, the relative position between the head case 11 and the electric substrate 14 are defined by urging the electric substrate 14 towards the first side in the W direction (the Y direction in the modification in FIG. 19) with the urging members 53, by having the surface of the internal circumferential surface of the positioning through hole 47 on the second side in the fourth direction contact the surface of the positioning portion 49 of the positioning pipe 21 on the second side in the W direction, and by having a lateral surface of the electric substrate 14 on the first side in the W direction contact the abutting surface 55 of the protruded portion 54. In such a configuration as well, the relative position between the head case 11 and the electric substrate 14 is defined highly accurately. Note that it is only sufficient that the abutting surface 55 is disposed on the opposite side in the longitudinal direction (the X direction in the present modification) of the electric substrate 14 with respect to the set of positioning pipe 21 and the positioning through hole 47 with the imaginary center Cb of the electric substrate 14 in between, and on the first side in the fourth direction, which is the direction in which the urging member 53 urges the electric substrate 14. In such a case as well, the positioning accuracy improves when the distance between the set of the positioning pipe 21 and the positioning through hole 47, and the abutting surface 55 is longer. Furthermore, it is desirable that the abutting surface 55 be a surface formed in a highly accurate manner by lapping and the like. It is more desirable since the positioning accuracy becomes improved as the area becomes smaller. Furthermore, the abutting surface 55 is not limited to a surface configured as a portion of the head case 11 and, for example, can be configured of a member different from the head case 11. In such a case, the member including the abutting surface 55 can be configured of a material different from that of the head case 11 such as, for example, metal. Other configurations are similar to those of the third exemplary embodiment.

Figure 20:
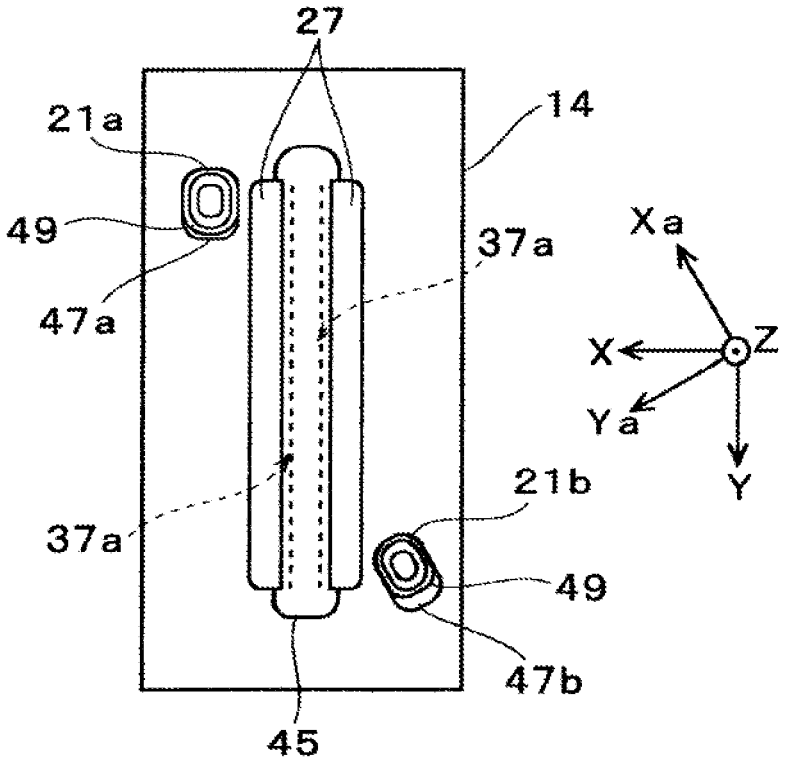
FIG. 20 is a plan view of a liquid ejecting head according to a fourth exemplary embodiment.

FIG. 20 is a plan view of the liquid ejecting head 3 according to a fourth exemplary embodiment viewed in the +Z direction. Illustration of the liquid supplying unit 10 and the mounted components 44 and the like on the electric substrate 14 are omitted. The present exemplary embodiment is different from the exemplary embodiments described above in that the electric substrate 14 is long in the Y direction, which is the nozzle row direction. In the present exemplary embodiment, two nozzle rows 37*a*, each provided in the Y direction, are arranged in the X direction, and a single set of positioning pipe 21 and the positioning through hole 47 are provided for each nozzle row 37*a*. More specifically, a single set of positioning pipe 21 and positioning through hole 47 is provided on the first side (the upper side in FIG. 20) and on the second side (the lower side in FIG. 20) with respect to the center (the position corresponding to the imaginary center Cb of the electric substrate 14 in the present exemplary embodiment) of the nozzle rows 37*a* in the Y direction. The distance between the first pipe 21*a* and the second pipe 21*b* (in other words, the distance between the center of the first pipe 21*a* and the center of the second pipe 21*b* in the Z direction when in plan view), which are positioning pipes 21 disposed on both sides, is longer than the dimension of the electric substrate 14 in the short direction (the X direction in the present exemplary embodiment). In the present exemplary embodiment, a direction in which the sets of positioning pipe 21 and positioning through hole 47 are arranged is referred to as the Xa direction, and a direction orthogonal to the Xa direction is referred to as the Ya direction.

The positioning through hole 47 in the set, among the sets of positioning pipe 21 and the positioning through hole 47, disposed on the first side is a first positioning through hole 47*a* in which the gap with the external circumferential surface of the positioning portion 49 is formed small within a range allowing the positioning portion 49 of the first pipe 21*a* to be inserted therethrough, and the positioning through hole 47 in the set disposed on the second side is the second positioning through hole 47*b* in which, while the dimension in the Ya direction is set to match the dimension of the first positioning through hole 47*a* in the X direction, the dimension in the Xa direction is set larger than the dimension of the first positioning through hole 47*a* in the Y direction. In accordance with the above, the second pipe 21*b* formed in an elliptic shape in plan view is formed so that the major axis direction extends in the Xa direction, and the minor axis direction extends in the Ya direction. With the above, the gap G in the Xa direction, which is the direction in which the set of the first pipe 21*a* and the first positioning through hole 47*a* and the set of the second pipe 21*b* and the second positioning through hole 47*b* are arranged, is larger than the gap G between the second pipe 21*b* and the second positioning through hole 47*b* in the Ya direction. With the above, positioning of the head case 11 and the electric substrate 14 can be performed while absorbing the error between the distance between the first pipe 21*a* and the second pipe 21*b* and the distance between the positioning through holes 47*a* and 47*b*. Note that when the error between the distance between the positioning pipes 21 and the distance between the positioning through holes 47 is not an issue, the positioning through hole 47 on the second side can be the first positioning through hole 47*a*.

As described above, in the present exemplary embodiment, since the set of the first pipe 21*a* and the positioning through hole 47*a* is disposed at a position corresponding to a first end portion of the nozzle row 37*a* arranged in the X direction on the first side (the left side in FIG. 20), and the set of the second pipe 21*b* and the positioning through hole 47*b* is disposed at a position corresponding to a second end portion of the nozzle row 37*a* arranged in the X direction and on the second side (the right side in FIG. 20), a longer distance can be obtained between the above sets. Furthermore, when the electric substrate 14 is layered on the layered surface of the head case 11, the position of the electric substrate 14 with respect to the head case 11 is determined by inserting the first pipe 21*a* and the second pipe 21*b* on both sides in the Y direction through the positioning through holes 47*a* and 47*b*, respectively, and by having the internal circumferential surface of each positioning through hole 47 come in contact with the external circumferential surface of the positioning portion 49 of the corresponding positioning pipe 21. In the present exemplary embodiment as well, there is no need to, other than the positioning pipes 21 and the positioning through holes 47, separately provide positioning pins and positioning holes that position the head case 11 and the electric substrate 14. Accordingly, more space, amounting to the space saved with the above, for disposing the wiring and the mounted components 44 can be obtained on the electric substrate 14 and a reduction in the size of the electric substrate 14 can be achieved. As a result, a contribution to size reduction of the liquid ejecting head 3 can be made. Note that when the electric substrate 14 is long in the direction of the nozzle rows 37*a*, the number of the nozzle rows 37*a* is not limited to two that has been illustrated as an example and can be one or three or more. In such a case, it is only sufficient that the sets of the positioning pipe 21 and the positioning through hole 47 through which the positioning pipe 21 is inserted are disposed, in the short direction of the electric substrate 14, outside the area where the nozzle rows 37*a* are formed and on the first side and the second side of the nozzle rows 37*a* in the Y direction.

Figure 21:
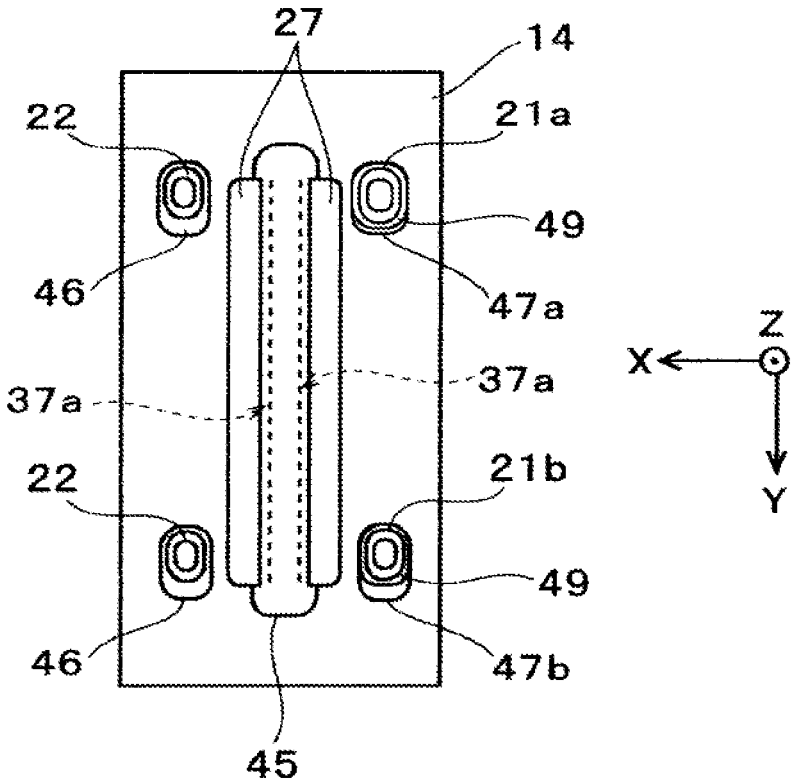
FIG. 21 is a plan view of a liquid ejecting head according to a first modification of the fourth exemplary embodiment.

FIG. 21 is a plan view of the liquid ejecting head 3 according to a first modification of the fourth exemplary embodiment viewed in the +Z direction. Illustration of the liquid supplying unit 10 and the mounted components 44 and the like on the electric substrate 14 are omitted. In the present modification, two sets of the third pipe 22 and the through hole 46 or two sets of the positioning pipe 21 and the positioning through hole 47 are provided for each of the nozzle row 37*a*. More specifically, corresponding to the nozzle row 37*a* disposed on the first side (the left side in FIG. 21) in the X direction, a set of the third pipe 22 and the through hole 46 are provided, with respect to the center of the nozzle row 37*a*, on each of the first side (the upper side in FIG. 21) and the second side (the lower side in FIG. 21) in the Y direction. Furthermore, corresponding to the nozzle row 37*a* disposed on the second side (the right side in FIG. 21) in the X direction, a set of the first pipe 21*a* and the first positioning through hole 47*a* is provided, with respect to the center of the nozzle row 37*a*, on the first side in the Y direction and a set of the second pipe 21*b* and the second positioning through hole 47*b* is provided, with respect to the center of the nozzle row 37*a*, on the second side. In the present modification as well, when the electric substrate 14 is layered on the layered surface of the head case 11, the position of the electric substrate 14 with respect to the head case 11 is determined by inserting the first pipe 21*a* and the second pipe 21*b* on both sides in the Y direction through the positioning through holes 47*a* and 47*b*, respectively, and by having the internal circumferential surface of the positioning through holes 47*a* and 47*b* come in contact with the external circumferential surface of the positioning portion 49 of the first pipe 21*a* and the second pipe 21*b*, respectively. Note that in the present modification, a configuration in which, regarding the positional relationship between the set of the first pipe 21*a* and the first positioning through hole 47*a* and the set of the second pipe 21*b* and the second positioning through hole 47*b*, the positions in the X direction are the same has been described as an example; however, not limited to the above and similar to the fourth exemplary embodiment, the positions in the X direction may be different. Furthermore, it is only sufficient that at least the set of the first pipe 21*a* and the first positioning through hole 47*a* is included, and the set of the second pipe 21*b* and the second positioning through hole 47*b* does not necessarily have to be included. In such a case, a configuration in which the third pipe 22 and the through hole 46 are provided at positions corresponding to the set of the second pipe 21*b* and the second positioning through hole 47*b* may be adopted. Other configurations are similar to those of the fourth exemplary embodiment.

Figure 22:
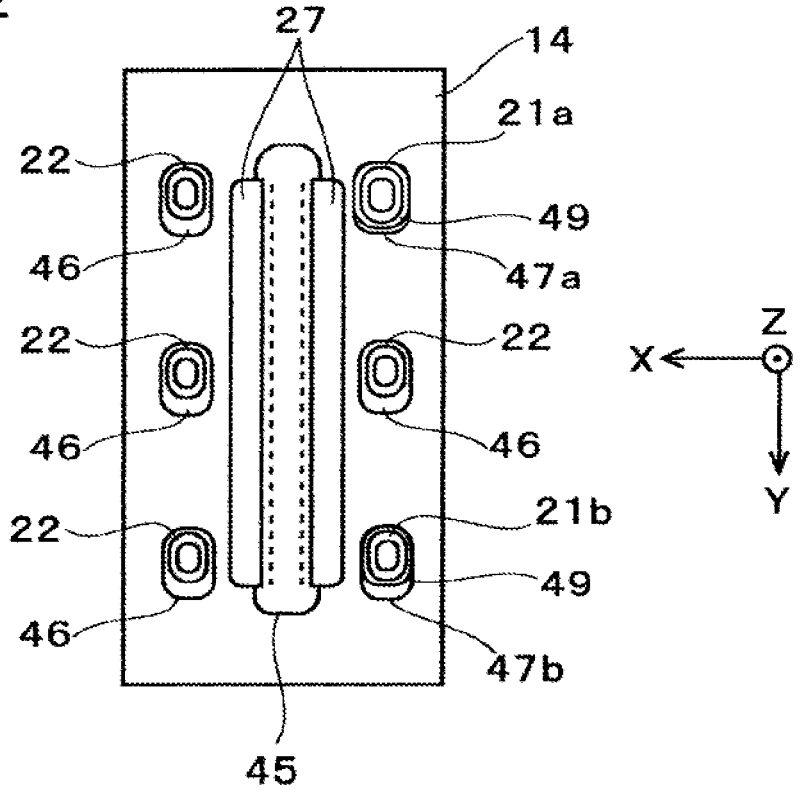
FIG. 22 is a plan view of a liquid ejecting head according to a second modification of the fourth exemplary embodiment.

FIG. 22 is a plan view of the liquid ejecting head 3 according to a second modification of the fourth exemplary embodiment viewed in the +Z direction. Illustration of the liquid supplying unit 10 and the mounted components 44 and the like on the electric substrate 14 are omitted. In the present modification, three sets including the set of the third pipe 22 and the through hole 46 and the set of the positioning pipe 21 and the positioning through hole 47 are provided for each of the nozzle row 37*a*. More specifically, corresponding to the nozzle row 37*a* disposed on the first side (the left side in FIG. 22) in the X direction, three sets of the third pipe 22 and the through hole 46 are disposed with a space between each other. Furthermore, corresponding to the nozzle row 37*a* disposed on the second side (the right side in FIG. 22) in the X direction, the set of the first pipe 21*a* and the first positioning through hole 47*a*, the set of the third pipe 22 and the through hole 46, and the set of the second pipe 21*b* and the second positioning through hole 47*b* are provided in that order from the first side towards the second side in the Y direction with a space between each other. Note that other configurations are similar to those of the fourth exemplary embodiment.

Figure 23:
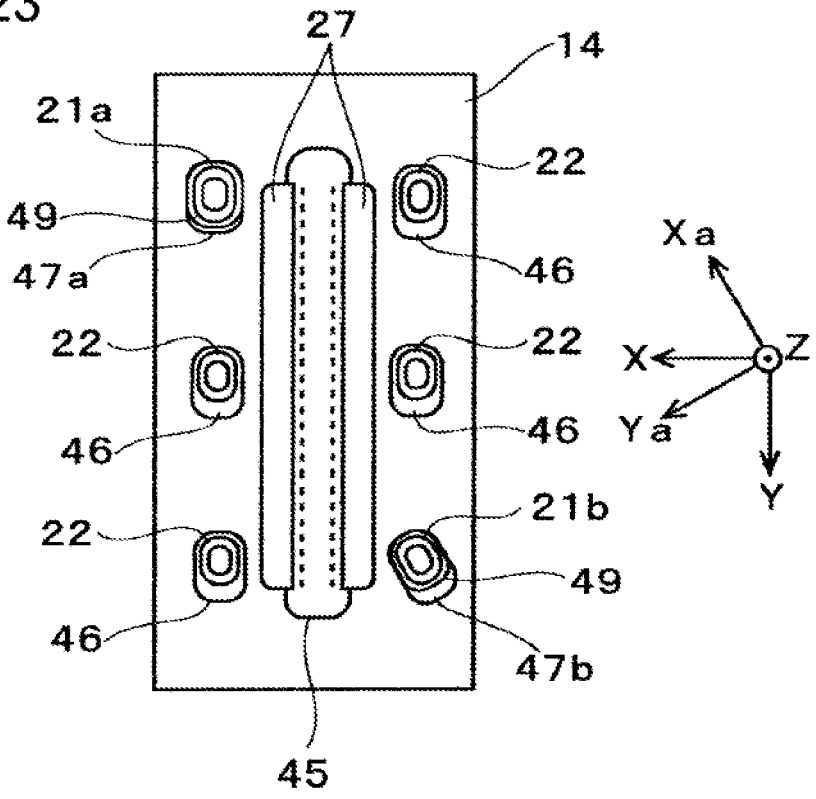
FIG. 23 is a plan view of a liquid ejecting head according to a third modification of the fourth exemplary embodiment.

FIG. 23 is a plan view of the liquid ejecting head 3 according to a third modification of the fourth exemplary embodiment viewed in the +Z direction. Illustration of the liquid supplying unit 10 and the mounted components 44 and the like on the electric substrate 14 are omitted. In the present modification, three sets including the set of the third pipe 22 and the through hole 46 and the set of the positioning pipe 21 and the positioning through hole 47 are provided for each of the nozzle row 37*a*. More specifically, corresponding to the nozzle row 37*a* disposed on the first side (the left side in FIG. 23) in the X direction, the set of the first pipe 21*a* and the first positioning through hole 47*a* and two sets of the third pipe 22 and the through hole 46, or a total of three sets, are provided with a space between each other. Furthermore, corresponding to the nozzle row 37*a* disposed on the second side (the right side in FIG. 23) in the X direction, two sets of the third pipe 22 and the through hole 46, and the set of the second pipe 21*b* and the second positioning through hole 47*b* are provided in that order from the first side towards the second side in the Y direction with a space between each other. Similar to the fourth exemplary embodiment, while the dimension of the second positioning through hole 47*b* according to the present modification in the Ya direction is set to match the dimension of the first positioning through hole 47*a* in the X direction, the dimension in the Xa direction is set larger than the first positioning through hole 47*a* in the Y direction. In accordance with the above, the second pipe 21*b* formed in an elliptic shape in plan view is formed so that the major axis direction extends in the Xa direction, and the minor axis direction extends in the Ya direction. With the above, positioning of the head case 11 and the electric substrate 14 can be performed while absorbing the error between the distance between the first pipe 21*a* and the second pipe 21*b* and the distance between the positioning through holes 47*a* and 47*b*. Other configurations are similar to those of the fourth exemplary embodiment. According to the above configuration, compared with the second modification, a longer distance between the set of the positioning pipe 21 and the positioning through hole 47*a* and the set of the positioning pipe 21 and the positioning through hole 47*b* on the second side can be obtained; accordingly, the positioning accuracy is improved. Other configurations are similar to those of the fourth exemplary embodiment.

Note that in the exemplary embodiments described above, a configuration in which the positioning is performed with sets of positioning pipe 21 and the positioning through hole 47, or a configuration in which positioning is performed with a set of positioning pipe 21 and the positioning through hole 47, and the abutting surface 55 have been described as examples; however, not limited to the above configurations, a configuration in which the positioning of the head case 11 and the electric substrate 14 is performed using the set of the positioning pipe 21 and the positioning through hole 47 and a set of a positioning pin and a positioning hole, which is a known technique, can be adopted. In other words, by adopting at least one set of the positioning pipe 21 and the positioning through hole 47 as the component that positions the head case 11 and the electric substrate 14, more space, amounting to the space saved with the above, for disposing the wiring and the mounted components 44 can be obtained on the electric substrate 14 and a reduction in the size of the electric substrate 14 can be achieved.

Furthermore, in the exemplary embodiments described above, while the nozzle rows 37*a* have been provided in the transport direction (the Y direction) of the medium 2, a configuration in which the nozzle rows 37*a* are provided in a direction inclined from the transport direction (the Y direction) of the medium 2 can be adopted as well.

Furthermore, the liquid ejecting head 3 of each exemplary embodiment described above is a so-called serial head that performs printing operation by ejecting a liquid while the carriage 4 reciprocates in the X direction; however, a so-called line head in which, by arranging a plurality of liquid ejecting heads 3 in the X direction, the dimension of the plurality of liquid ejecting heads 3 in the X direction becomes larger than the size of the medium 2 in the width direction (the X direction) can be adopted.

Furthermore, a description has been given above with an ink jet liquid ejecting head, which is a type of liquid ejecting head, as an example; however, the present disclosure can adopt other liquid ejecting heads that adopt a configuration in which the flow path member and the electric substrate are positioned and layered. For example, the present disclosure can also be applied to a color material ejecting head used to manufacture a color filter of a liquid crystal display and the like, an electrode material ejecting head used to form electrodes of an organic electroluminescence (EL) display and a field emission display (FED), a bio-organic matter ejecting head used to manufacture biochips (biotips).

What is claimed is:

1. A liquid ejecting head comprising:

nozzles ejecting a liquid;

a flow path member including flow paths that communicate with the nozzles; and an electric substrate stacked on the flow path member in a first direction, wherein the flow path member includes pipes that protrude in the first direction from a surface facing the electric substrate, the flow paths respectively being formed inside the pipes, through holes through which the pipes are inserted are provided in the electric substrate, the through holes include a first through hole and a second through hole, and the pipes include a first pipe that includes a first contact surface that contacts an internal circumferential surface of the first through hole, and a second pipe that includes a second contact surface that contacts an internal circumferential surface of the second through hole.

2. The liquid ejecting head according to claim 1, wherein the first pipe is disposed on a first end side in a longitudinal direction of the electric substrate when viewed in the first direction, and the second pipe is disposed on a second end side in the longitudinal direction of the electric substrate when viewed in the first direction.

3. The liquid ejecting head according to claim 2, wherein the nozzles constitute a nozzle row by being disposed in a second direction, the first pipe is provided in the second direction with respect to a center of the nozzle row in the second direction, and the second pipe is provided in a direction opposite the second direction with respect to the center of the nozzle row in the second direction.

4. The liquid ejecting head according to claim 1, wherein the nozzles constitute a nozzle row by being disposed in a second direction, the first pipe is provided in the second direction with respect to a center of the nozzle row in the second direction, and the second pipe is provided in a direction opposite the second direction with respect to the center of the nozzle row in the second direction.

5. The liquid ejecting head according to claim 1, wherein the nozzles constitute nozzle rows by being disposed in a second direction, the nozzle rows are arranged in a third direction that intersects the second direction, the first pipe is disposed on a first end side in a longitudinal direction of the electric substrate when viewed in the first direction, and the second pipe is disposed on a second end side in the longitudinal direction of the electric substrate when viewed in the first direction.

6. The liquid ejecting head according to claim 5, wherein the nozzle rows include a first nozzle row and a second nozzle row, the first nozzle row and the second nozzle row are, in the third direction, disposed at both ends among the nozzle rows, and the first pipe and the second pipe are, in the third direction, disposed outside the first nozzle row and the second nozzle row.

7. The liquid ejecting head according to claim 6, wherein the first pipe is provided in the second direction with respect to a center of the nozzle row in the second direction, and the second pipe is provided in a direction opposite the second direction with respect to the center of the nozzle row in the second direction.

8. The liquid ejecting head according to claim 5, wherein the first pipe is provided in the second direction with respect to a center of the nozzle row in the second direction, and the second pipe is provided in a direction opposite the second direction with respect to the center of the nozzle row in the second direction.

9. The liquid ejecting head according to claim 5, wherein 10 nozzle rows are provided.

10. The liquid ejecting head according to claim 1, further comprising:

an urging member urging the electric substrate to a fourth direction, wherein a surface of the internal circumferential surface of the first through hole in a fifth direction opposite to the fourth direction contacts a surface of the first contact surface in the fifth direction, and a surface of the internal circumferential surface of the second through hole in the fifth direction contacts a surface of the second contact surface in the fifth direction.

11. The liquid ejecting head according to claim 1, wherein the through holes include a third through hole, the pipes include a third pipe inserted through the third through hole not so as to contact each other, and the first pipe and the second pipe are two pipes that are disposed farthest away from each other among the pipes.

12. A liquid ejecting apparatus comprising:

the liquid ejecting head according to claim 1; and a liquid storing member storing a liquid supplied to the liquid ejecting head.

13. A liquid ejecting apparatus comprising:

the liquid ejecting head according to claim 1; and a flexible flat cable connected to a connector provided on the electric substrate.

14. A method of manufacturing the liquid ejecting head according to claim 1, the method comprising:

positioning the electric substrate and the flow path member by contacting the first contact surface of the first pipe and the internal circumferential surface of the first through hole to each other and by contacting the second contact surface of the second pipe and the internal circumferential surface of the second through hole to each other.

* * * * *